US007365701B2

(12) United States Patent
Werner et al.

(10) Patent No.: US 7,365,701 B2
(45) Date of Patent: Apr. 29, 2008

(54) SYSTEM AND METHOD FOR GENERATING A GENETICALLY ENGINEERED CONFIGURATION FOR AT LEAST ONE ANTENNA AND/OR FREQUENCY SELECTIVE SURFACE

(75) Inventors: Douglas H. Werner, State College, PA (US); Pingjuan L. Werner, State College, PA (US); Kenneth H. Church, Stillwater, OK (US); Michael John Wilhelm, Stillwater, OK (US)

(73) Assignee: Sciperio, Inc., Oklahoma City, OK (US)

( * ) Notice: Subject to any disclaimer, the term of this patent is extended or adjusted under 35 U.S.C. 154(b) by 1304 days.

(21) Appl. No.: 10/072,739

(22) Filed: Feb. 8, 2002

(65) Prior Publication Data

US 2003/0034918 A1 Feb. 20, 2003

Related U.S. Application Data

(60) Provisional application No. 60/267,146, filed on Feb. 8, 2001, provisional application No. 60/349,185, filed on Jan. 15, 2002.

(51) Int. Cl.
*H01Q 1/24* (2006.01)

(52) U.S. Cl. ..... 343/909; 703/2

(58) Field of Classification Search ..... 343/700 MS, 343/756, 909; 703/2; 364/578
See application file for complete search history.

(56) References Cited

U.S. PATENT DOCUMENTS 3,780,373 A 12/1973 Holst et al. ..... 343/788
4,706,050 A 11/1987 Andrews ..... 333/205
5,598,032 A 1/1997 Fidalgo ..... 257/679
5,719,794 A * 2/1998 Altshuler et al. ..... 703/1
5,867,397 A 2/1999 Koza et al. ..... 364/489
5,959,594 A 9/1999 Wu et al. ..... 343/909
6,067,056 A 5/2000 Lake ..... 343/873
6,081,235 A 6/2000 Romanofsky et al. ..... 343/700 MS (Continued)

OTHER PUBLICATIONS

Article Evolutionary Design of Miniaturized Meander-Line Antennas for RFID Applications, by Marrocco et al., Proceedings of the *Antennas and Propogation Society International Symposium and USNC/URSI National Radio Science Meeting, 2002, IEEE*, vol. 2, pp. 362-365, San Antonio, Texas, Jun. 16-21, 2002.

(Continued)

*Primary Examiner*—Tan Ho
(74) *Attorney, Agent, or Firm*—Needle & Rosenberg, P.C.

(57) ABSTRACT

An optimal configuration for at least one antenna and/or at least one frequency selective surface is generated. A configuration of elements is generated by selecting a simple configuration of at least one element and applying a genetic algorithm to the simple configuration to generate a configuration optimized for various characteristics. A stochastic process may be used to randomly select an arrangement of elements as the simple antenna configuration and to select elements that connect the randomly selected elements to produce a stochastic configuration to which the genetic algorithm is then applied. Alternatively, an iterated or semi-iterated process may be applied to the simple antenna configuration to produce a fractal or a semi-fractal configuration, respectively, to which the genetic algorithm is then applied. Also, the elements may be optimized independently.

71 Claims, 43 Drawing Sheets

U.S. PATENT DOCUMENTS

| | | | | |
|---|---|---|---|---|
| 6,081,242 | A | 6/2000 | Wingo | 343/860 |
| 6,104,349 | A | 8/2000 | Cohen | 343/702 |
| 6,107,975 | A | 8/2000 | Brennan et al. | 343/853 |
| 6,127,977 | A | 10/2000 | Cohen | 343/700 MS |
| 6,140,975 | A | 10/2000 | Cohen | 343/846 |
| 6,323,809 | B1 * | 11/2001 | Maloney et al. | 343/700 MS |
| 6,483,481 | B1 | 11/2002 | Sievenpiper et al. | 343/909 |
| 6,498,587 | B1 | 12/2002 | Desclos et al. | 343/700 MS |
| 6,567,049 | B1 * | 5/2003 | Huang et al. | 343/700 MS |
| 6,919,851 | B2 * | 7/2005 | Rogers et al. | 343/749 |
| 2003/0034918 | A1 | 2/2003 | Werner et al. | 343/700 MS |
| 2003/0046042 | A1 | 3/2003 | Butler et al. | 703/2 |
| 2004/0135727 | A1 * | 7/2004 | Werner et al. | 343/700 MS |
| 2004/0201526 | A1 * | 10/2004 | Knowles et al. | 343/700 MS |

OTHER PUBLICATIONS

Article A Uniplanar Compact Photonic-Bandgap (UC-PBG) Structure and Its Applications for Microwave Circuits, by Yang et al., published in *IEEE Transactions on Microwave Theory and Techniques*, vol. 47, No. 8, Aug. 1999, pp. 1509-1514.

Article Aperture-Coupled Patch Antenna on Uc-PBG Substrate, by Coccioli et al., published in *IEEE Transactions on Microwave Theory and Techniques*, vol. 47, No. 11, Nov. 1999, pp. 2123-2130.

*Chaos and Fractals New Frontiers of Science*, by Heinz-Otto Peitgen et al., pp. 168-296, © 1988 by Springer-Verlag.

Article Fractal Arrays Based on Iterated Functions System (IFS), by Baharav, © 1999 *IEEE*, pp. 2686-2689.

Chapter 2 of *Frontiers in Electromagnetics*, (*IEEE* Press Series on Microwave Technology and RF) Fractal-Shaped Antennas, by Puente et al., pp. 48-203© 2000.

Practical Genetic Algorithms, by Haupt et al. © 1998 by John Wiley & Sons, Inc.

Electromagnetic Optimization By Genetic Algorithms, edited by Rahmat-Samii et al., published by John Wiley & Sons, Inc. © 1999.

PCT International Search Report, International Application No. PCT/US02/03739, mailed Dec. 18, 2002.

Article A Design Approach for Dual-Polarized Multiband Frequency Selective Surfaces Using Fractal Elements, by Werner et al., published in IEEE, 2000, pp. 1692-1695.

Article Frequency Independent Features of Self-Similar Fractal Antennas, by Werner et al., published in IEEE 1996, pp. 2050-2053.

Article Fractal Antenna Engineering: The Theory and Design of Fractal Antenna Arrays, by Werner et al., published in *IEEE Antennas and Propagation Magazine*, vol. 41, No. 5, Oct. 1999, pp. 37-59.

Article Genetic Algorithm Optimization of Stacked Vertical Dipoles Above a Ground Plane, by Werner et al., published in *Antennas and Propagation Society International Symposium*, 1997 Digest, pp. 1975-1979.

Article Toward the Synthesis of an Artificial Magnetic Medium, by Hagen et al., published in IEEE, 1999, pp. 430-433.

Article A Simple Broadband Dipole Equivalent Circuit Model, by Long et al., published in IEEE, 2000, pp. 1046-1049.

Article Fractal Coding in Genetic Algorithm (GA) Antenna Optimization, by Nathan Cohen, published in IEEE, 1997, pp. 1692-1695.

"High Impedance Electromagnetic Surfaces" by Sievenpiper, 1999.

"A High Impedance Ground Plane Applied to a Cellphone Handset Geometry" by Sievenpiper, 2000 *IEEE*.

"High-Impedance Metamaterial Surface using Hilbert-Curve Inclusions" by McVay et al., *2000 IEEE*.

"Genetic Optimization of Fractal Dipole Antenna Arrays for Compact Size and Improved Impedance Performance Over Scan Angle," by Mummareddy et al,2000 *IEEE*, pp. 98-101.

"Low Voltage Tunable Barium Strontium Titanate Thin Film Capacitors for RF and Microwave Applications," Tombak et al.; 2000 IEEE MTT-S Digest, pp. 1345-1348.

"Design of dual-polarised multiband frequency selective surfaces using fractal elements," by Werner et al., Electronics Letters, Mar. 16, 2000, vol. 36, No. 6, pp. 487-488.

"On the Application of the Microgenetic Algorithm to the Design of Broad-Band Microwave Absorbers Comprising Frequency-Selective Surfaces Embedded in Multilayered Dielectric Media," by Chakravarty et al., Jun. 2001 IEEE *Transactions on Microwave Theory and Techniques*, vol. 49, No. 6, pp. 1050-1059.

"New Genetic-Algorithm-based Frequency Selective Surface Design for Dual Frequency Applications," by Monorchio et al., 1999 *IEEE*, pp. 1722-1725.

"Design of convoluted wire antennas using a genetic algorithm," by Chuprin et al., *IEE Proc-Microw. Antennas Propag.*, vol. 148, No. 5, Oct. 2001.

"High-Impedance Electromagnetic Ground Planes," by Sievenpiper et al., 1999 *IEEE MTT-S Digest*, pp. 1529-1532.

"High-Impedance Electromagnetic Surfaces with a Forbidden Frequency Band," by Sievenpipes et al., *IEEE Transactions on Microwave Theory and Techniques*, vol. 49, No. 11, Nov. 1999, pp. 2059-2074.

Antennas Research Activities at Loughborough University, by Professor Yiannis C. Verdaxoglou, printed Oct. 10, 2002 from website http://www.lboro.ac.uk/departments/el/research/.

"High-Impedance Electromagnetic Surfaces," thesis by Sievenpiper, 1999.

* cited by examiner

| a | b | c | d | e | f |
|---|---|---|---|---|---|
| 0.255 | 0.0 | 0.0 | 0.255 | 0.3726 | 0.6714 |
| 0.255 | 0.0 | 0.0 | 0.255 | 0.1146 | 0.2232 |
| 0.255 | 0.0 | 0.0 | 0.255 | 0.6306 | 0.2232 |
| 0.370 | −0.642 | 0.642 | 0.370 | 0.6356 | −0.0061 |

| a | b | c | d | e | f |
|---|---|---|---|---|---|
| 0.195 | −0.488 | 0.344 | 0.443 | 0.4431 | 0.2452 |
| 0.462 | 0.414 | −0.252 | 0.361 | 0.2511 | 0.5692 |
| −0.058 | −0.07 | 0.453 | −0.111 | 0.5976 | 0.0969 |
| −0.035 | 0.07 | −0.469 | −0.022 | 0.4884 | 0.5069 |
| −0.637 | 0.0 | 0.0 | 0.501 | 0.8562 | 0.2513 |

LENGTH OF ANTENNA = 12 cm
LOAD LOCATIONS : LOAD1 ELEMENT 21 L1 = 15.81250 nH C1 = 0.4849 pF
LOAD2 ELEMENT 06 L2 = 17.98438 nH C2 = 0.7996 pF

| FREQUENCY | VSWR |
|---|---|
| 1225 MHz | 1.3383 |
| 1575 MHz | 1.2872 |

LENGTH OF ANTENNA = 11.5 cm
LOAD LOCATIONS : LOAD1 ELEMENT 21 L1 = 15.53125 nH C1 = 0.5376 pF
LOAD2 ELEMENT 06 L2 = 17.95312 nH C2 = 0.8453 pF

| FREQUENCY | VSWR |
|---|---|
| 1225 MHz | 1.2649 |
| 1575 MHz | 1.2266 |

LENGTH OF ANTENNA = 11.0 cm
LOAD LOCATIONS : LOAD1 ELEMENT 05 L1 = 17.26562 nH C1 = 0.4708 pF
LOAD2 ELEMENT 04 L2 = 17.89062 nH C2 = 0.9648 pF

| FREQUENCY | VSWR |
|---|---|
| 1225 MHz | 1.0738 |
| 1575 MHz | 1.3285 |

LENGTH OF ANTENNA = 10.5 cm
LOAD LOCATIONS : LOAD1 ELEMENT 22 L1 = 13.93750 nH C1 = 0.6414 pF
LOAD2 ELEMENT 04 L2 = 18.92188 nH C2 = 0.9050 pF

| FREQUENCY | VSWR |
|---|---|
| 1225 MHz | 1.1249 |
| 1575 MHz | 1.1205 |

LENGTH OF ANTENNA = 10.0 cm
LOAD LOCATIONS : LOAD1 ELEMENT 25 L1 = 15.98438 nH C1 = 0.5746 pF
LOAD2 ELEMENT 23 L2 = 13.39062 nH C2 = 0.6712 pF

| FREQUENCY | VSWR |
|---|---|
| 1225 MHz | 1.1884 |
| 1575 MHz | 1.1103 |

LENGTH OF ANTENNA = 9.5 cm
LOAD LOCATIONS : LOAD1 ELEMENT 22 L1 = 13.48438 nH C1 = 0.6941 pF
LOAD2 ELEMENT 25 L2 = 12.09375 nH C2 = 0.1509 pF

| FREQUENCY | VSWR |
|---|---|
| 1225 MHz | 1.0386 |
| 1575 MHz | 1.1186 |

LENGTH OF ANTENNA = 9.0 cm
LOAD LOCATIONS : LOAD1 ELEMENT 25 L1 = 12.04688 nH C1 = 0.3302 pF
LOAD2 ELEMENT 05 L2 = 15.43750 nH C2 = 0.6642 pF

| FREQUENCY | VSWR |
|---|---|
| 1225 MHz | 1.0392 |
| 1575 MHz | 1.1430 |

LENGTH OF ANTENNA = 8.5 cm

LOAD LOCATIONS : LOAD1 ELEMENT 25 L1 = 18.79688 nH C1 = 0.5570 pF

LOAD2 ELEMENT 09 L2 = 15.43750 nH C2 = 0.6853 pF

| FREQUENCY | VSWR |
|---|---|
| 1225 MHz | 1.1235 |
| 1575 MHz | 1.0224 |

LENGTH OF ANTENNA = 8.0 cm
LOAD LOCATIONS : LOAD1 ELEMENT 04 L1 = 13.42188 nH C1 = 0.1457 pF
LOAD2 ELEMENT 04 L2 = 16.15625 nH C2 = 0.7644 pF

| FREQUENCY | VSWR |
|---|---|
| 1225 MHz | 1.1432 |
| 1575 MHz | 1.0470 |

LENGTH OF ANTENNA = 7.5 cm
LOAD LOCATIONS : LOAD1 ELEMENT 04 L1 = 13.50000 nH C1 = 0.3671 pF
LOAD2 ELEMENT 25 L2 = 18.35938 nH C2 = 0.8910 pF

| FREQUENCY | VSWR |
|---|---|
| 1225 MHz | 1.0453 |
| 1575 MHz | 1.1628 |

LENGTH OF ANTENNA = 7.0 cm
LOAD LOCATIONS : LOAD1 ELEMENT 23 L1 = 17.95312 nH C1 = 0.8119 pF
LOAD2 ELEMENT 19 L2 = 19.50000 nH C2 = 0.1017 pF

| FREQUENCY | VSWR |
|---|---|
| 1225 MHz | 1.3338 |
| 1575 MHz | 1.1024 |

LENGTH OF ANTENNA = 6.5 cm
LOAD LOCATIONS : LOAD1 ELEMENT 22 L1 = 16.10938 nH C1 = 0.8962 pF
LOAD2 ELEMENT 12 L2 = 13.01562 nH C2 = 0.2107 pF

| FREQUENCY | VSWR |
|---|---|
| 1225 MHz | 1.6677 |
| 1575 MHz | 1.4982 |

LENGTH OF ANTENNA = 6.0 cm

LOAD LOCATIONS : LOAD1 ELEMENT 22 L1 = 16.35938 nH C1 = 0.8962 pF
LOAD2 ELEMENT 09 L2 = 16.12500 nH C2 = 0.3214 pF

| FREQUENCY | VSWR |
|---|---|
| 1225 MHz | 1.6956 |
| 1575 MHz | 1.4979 |

LENGTH OF ANTENNA = 5.5 cm
LOAD LOCATIONS : LOAD1 ELEMENT 22 L1 = 15.86914 nH C1 = 0.9308 pF
LOAD2 ELEMENT 16 L2 = 12.51172 nH C2 = 0.5371 pF

| FREQUENCY | VSWR |
|---|---|
| 1225 MHz | 1.9413 |
| 1575 MHz | 1.7861 |

| FREQUENCY (MHz) | VSWR | ZIN | GAIN |
|---|---|---|---|
| 1225.0 | 1.579067 | (32.47140,−6.125150) | 2.030 |
| 1575.0 | 1.262626 | (39.63660,−0.9270540) | 2.610 |

SYSTEM AND METHOD FOR GENERATING A GENETICALLY ENGINEERED CONFIGURATION FOR AT LEAST ONE ANTENNA AND/OR FREQUENCY SELECTIVE SURFACE

CROSS REFERENCE TO RELATED APPLICATIONS

This application claims priority from commonly assigned U.S. Provisional Patent Application No. 60/267,146, filed on Feb. 8, 2001, and U.S. Provisional Patent Application No. 60/349,185, filed on Jan. 15, 2002. These applications are hereby incorporated by reference.

BACKGROUND

The present invention is directed to a system and method for creating a pattern for at least one antenna and/or a frequency selective surface. More particularly, the present invention is directed to a system and method for creating a pattern for at least one antenna and/or a frequency selective surface using a genetic algorithm.

Fractal patterns have been discovered to be useful for generating antenna patterns. In the past, fractal patterns have been arbitrarily selected for antennas, and the radiation results determined. Depending on the radiation results, either the selected pattern was used for the antenna, or another pattern was selected.

A problem with this "trial and error approach" is that there are infinitely many types of possible fractal antenna configurations. Even within the same class of fractal antennas, there may be an extremely large number of possible variations of the shape. Thus, arbitrarily selecting fractal patterns may be a cumbersome and inefficient process. Also, this approach does not guarantee that the resulting fractal antenna has desired radiation characteristics but rather typically results in a fractal antenna design that is suboptimal.

Various other types of devices may also benefit from a procedure for optimizing patterns of elements. For example, Frequency Selective Surfaces (FSS) have been recently suggested for use in the design of electromagnetic metamaterials that behave like a Perfect Magnetic Conductor (PMC) (F. Yang, K. Ma, Y. Qian, and T. Itoh, *IEEE Trans. Microwave Theory Tech.*, 47, 1509-1514, 1999). It has been shown that an FSS screen acting as a PMC can be used to improve the radiation characteristics of an antenna placed in close proximity to or in the same plane as such a surface (R. Coccioli, F. Yang, K. Ma, and T. Itoh, *IEEE Trans. Microwave Theory Tech.*, 47, 2123-2130, 1999). However, one of the main drawbacks of these high impedance surfaces has their characteristically narrowband response.

Thus, there is a need for a method and technique for generating antenna configurations in an optimal manner. There is also a need for a technique for generating optimal patterns for other types of devices, e.g., a frequency selective surface with a high impedance capable of wideband or multiband performance.

SUMMARY

It is therefore an object of the present invention to provide a technique for generating an antenna configuration in an optimal manner. It is a further object of the invention to provide a technique for generating optimal patterns of elements for other types of devices, e.g., an optimized pattern of electromagnetic elements for a frequency selective surface with a high impedance capable of wideband or multiband performance.

According to exemplary embodiments, these and other objects are met by a method and system for generating an optimal configuration for an antenna and/or a frequency selective surface.

According to one aspect, a configuration of elements is generated for at least one antenna byselecting a simple antenna configuration including at least one antenna element and applying a genetic algorithm to the simple configuration to generate an antenna configuration optimized for antenna characteristics. The antenna characteristics may include, for example, voltage standing wave ratio, gain, size, bandwidth, radiation characteristics and/or impedance. According to one embodiment, candidate antenna configurations are generated, and radiation characteristics of the candidate antenna configurations are analyzed until an optimal antenna configuration is generated. The application of a genetic algorithm optimizes the geometry of elements, height of the antenna above a ground plane, and/or length of the antenna. In addition, the genetic algorithm may be applied to generate optimized load placement and/or optimized load values for the antenna configuration. Also, the genetic algorithm may be applied to generate optimized design parameters of a matching network or balun to be connected to the antenna.

According to one embodiment, an arbitrary arrangement of antenna elements may be selected as the simple antenna configuration. First elements may be randomly selected, and elements that connect the randomly selected elements may be selected to produce a stochastic configuration. The genetic algorithm is then applied to the stochastic configuration.

According to another embodiment, an iterated process may be applied to the simple configuration to produce a fractal pattern to which the genetic algorithm is applied. According to yet another embodiment, a semi-iterated process may be applied to the simple configuration to produce a semi-fractal pattern to which the genetic algorithm is applied.

According to exemplary embodiments, each of the antenna elements may be optimized independently.

According to exemplary embodiments, the genetic algorithm may be applied to generate a configuration of elements in at least one antenna. Also, the genetic algorithm may be applied to generate a configuration of antennas in an array.

According to another aspect, a pattern for at least one frequency selective surface is created, e.g., for improving radiation characteristics of an antenna, by selecting a pattern for arranging electromagnetic materials on a substrate or a superstrate and applying a genetic algorithm to the selected pattern to generate an optimized pattern of electromagnetic materials for forming a frequency selective surface on the substrate or superstrate. The application of the genetic algorithm modifies a geometry of the pattern. Also, the genetic algorithm may be applied to optimize the characteristics of the substrate or superstrate, such as the thickness and dielectric.

According to exemplary embodiments, the frequency selective surface is a high impedance, single band or multiband surface. The frequency selective surface may form a high impedance ground plane for a single band or multiband antenna.

According to one embodiment, patterns for multiple stacked frequency selective screens and dielectric layers may be produced. The genetic algorithm may be applied to optimize the characteristics of a stack of multiple frequency selective screens and dielectric layers. A conducting plate, e.g., a metallic conducting plate, may be included in the stack.

According to one embodiment, the frequency selective surface may be part of a shield for shielding radio frequency energy emitted by an antenna. Also, the frequency selective surface may contain adjustable components enabling a frequency response of the frequency selective surface to be adjusted.

The objects, advantages and features of the present invention will become more apparent when reference is made to the following description taken in conjunction with the accompanying drawings.

DETAILED DESCRIPTION

According to exemplary embodiments, a genetic algorithm may be used to generate a configuration of elements and/or electromagnetic patterns for devices such as antennas, antenna arrays, and frequency selective surfaces.

According to one aspect, the genetic algorithm is used to generate an optimized antenna configuration.

According to an exemplary embodiment, a simple configuration is initially selected, and the genetic algorithm is applied to that configuration. According to one embodiment, an iterated function system (IFS) may be applied to the simple pattern to produce a fractal antenna element (FAE) pattern, and the genetic algorithm may be applied to that fractal pattern.

To illustrate an example of an IFS, consider an affine linear transformation w given by six numbers:

$$\begin{bmatrix} a_n & b_n & | & e_n \\ & & | & \\ c_n & d_n & | & f_n \end{bmatrix} \tag{1}$$

where $$w_n(x,y)=(a_nx+b_ny+e_n,\ c_nx+d_ny+f_n) \tag{2}$$

Consider $w_1$, $w_2$, . . . $w_N$ as a set of affine linear transformations, and let A be the initial geometry. Then a new geometry produced by applying the set of transformations to the geometry A and collecting the results from $w_1(A)$, $w_2(A)$, . . . $w_N(A)$ can be expressed as:

$$W(A) = \bigcup_{i=1}^{N} w_i(A) \tag{3}$$

where W is called the Hutchison operator.

A fractal geometry can be obtained by repeatedly applying W to the previous set of the geometry. For example, if the set $A_0$ represents the initial geometry, then $$A_1=W(A_0),\ A_2=W(A_1),\ \ldots,\ A_{k+1}=W(A_k) \tag{4}$$

This represents an iterated function system (IFS).

Figure 1:
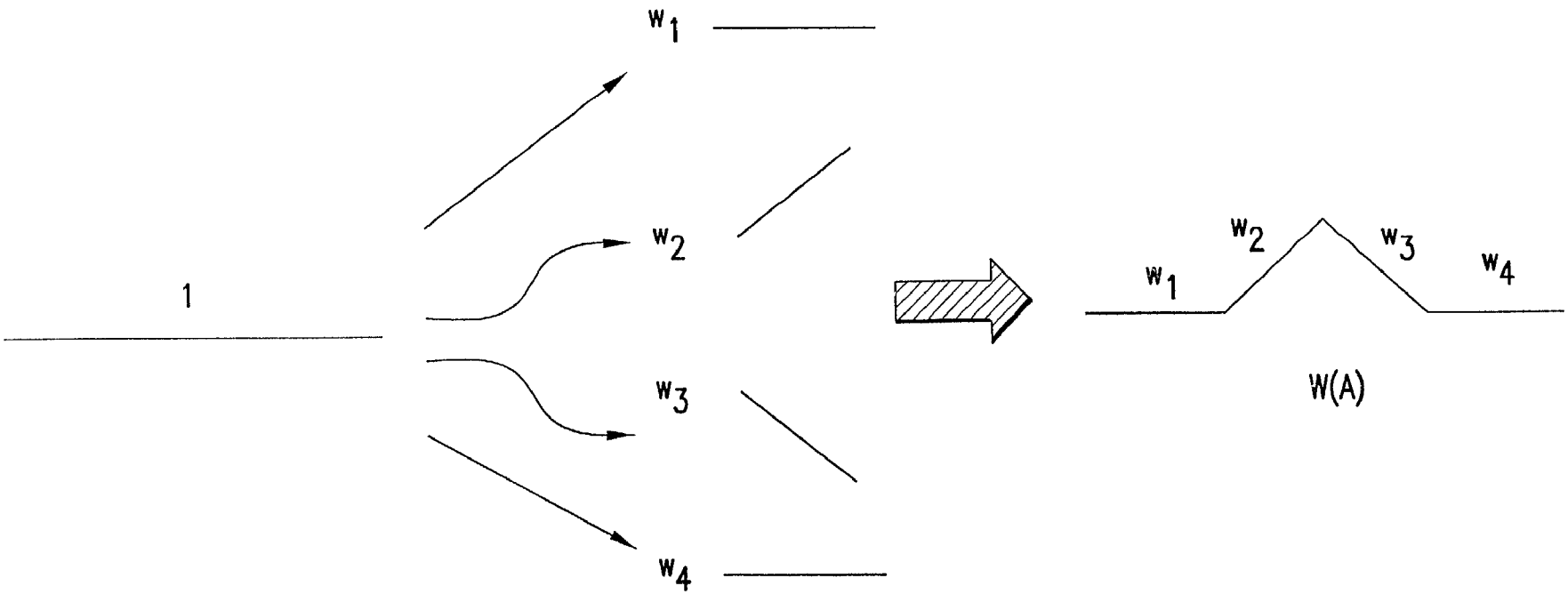
FIGS. 1 and 2 illustrate stages in Koch curve generation using an iterated function system (IFS) subroutine.
Figure 2:
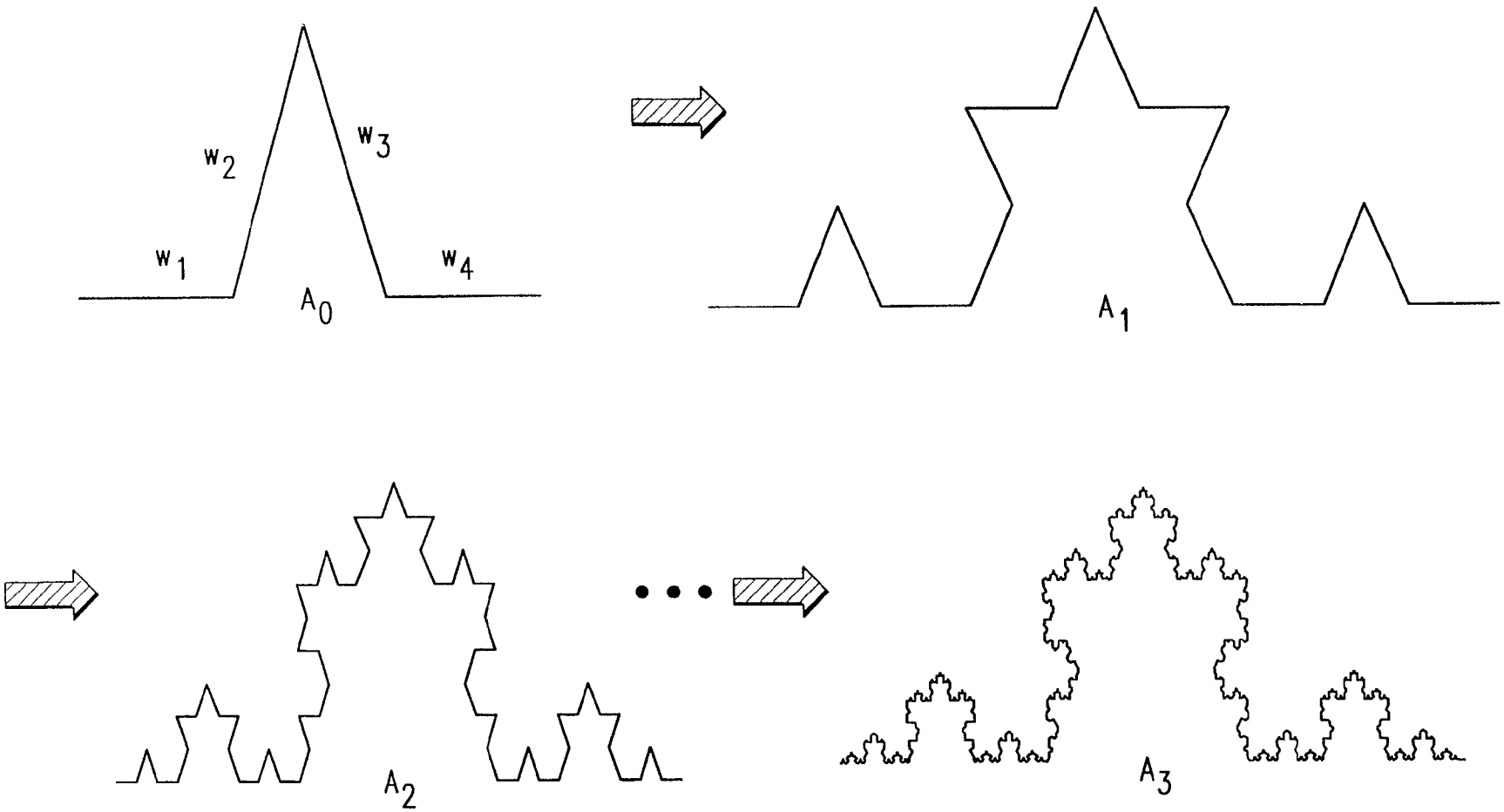

The IFS technique may further be understood by examining the generation of successively complex Koch curves, as shown in FIGS. 1 and 2.

In FIG. 1, an initial Koch pattern W(A) is derived. The initial image of the Koch curve may be expressed as:

$$w_1(x,y)=(\tfrac{1}{3}x,\ \tfrac{1}{3}y) \tag{5}$$

$$w_2(x,y)=(\tfrac{1}{6}x-\tfrac{\sqrt{3}}{6}y+\tfrac{1}{3},\ \tfrac{\sqrt{3}}{6}x+\tfrac{1}{6}y) \tag{6}$$

$$w_3(x,y)=(\tfrac{1}{6}x-\tfrac{\sqrt{3}}{6}y+\tfrac{1}{2},\ -\tfrac{\sqrt{3}}{6}x+\tfrac{1}{6}y+\tfrac{\sqrt{3}}{6}) \tag{7}$$

$$w_4(x,y)=(\tfrac{1}{3}x+{}^{197}/2;3,\ \tfrac{1}{3}y) \tag{8}$$

where $$W(A)=w_1(A)\cup w_2(A)\cup w_3(A)\cup w_4(A) \tag{9}$$

The higher stage Koch curves may be obtained by repeatedly applying W to the previous stage. FIG. 2 illustrates the fractal Koch curves $A_1$, $A_2$, and $A_3$ generated using an IFS at stage 2, stage 3, and stage 4, respectively. As can be seen from FIG. 2, the original simple pattern is repeated in each subsequent stage, each segment of the original pattern being replaced in each subsequent stage with a new pattern that is a copy of the original simple pattern. Though each new pattern may be a scaled, translated, and/or stretched copy of the original, the relative angles and proportions between the segments do not change. The new patterns are connected in manner corresponding to the connection of segments in the original pattern. Though a true fractal implies an infinite number of iterations, the "fractal pattern" created by an iterated process actually contains a finite number of iterations.

Figures 3, 3A:
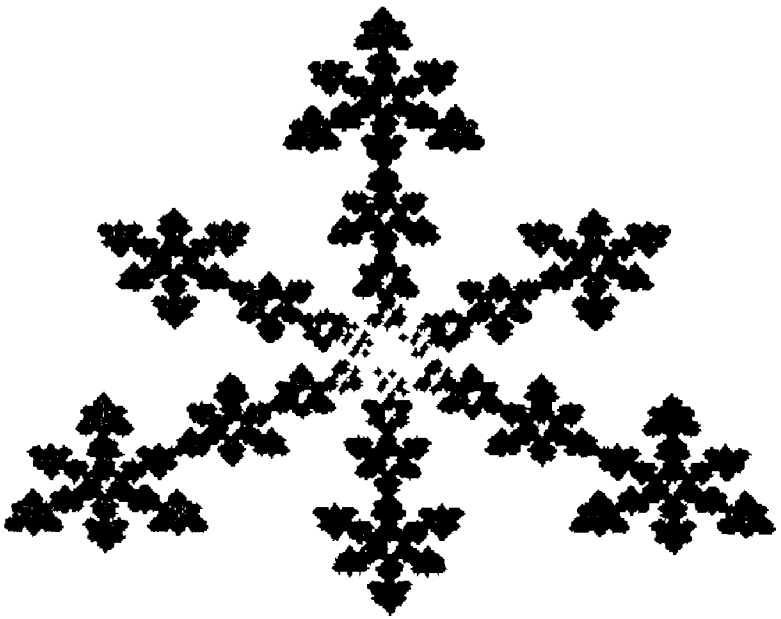
FIG. 3 illustrates an IFS generated crystal form and the parameters for the generation thereof.
Figures 4, 4A:
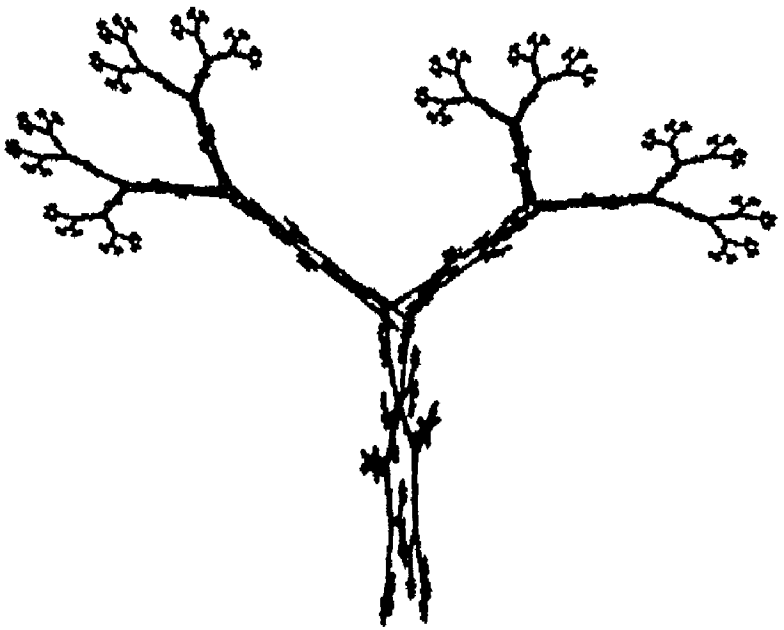
FIG. 4 illustrates an IFS generated tree form and the parameters for the generation thereof.

By varying the parameters a, b, c, d, e, and f, various patterns may be formed. For example, FIG. 3 shows a complex crystal form generated using certain values for the parameters, and FIG. 4 shows a fractal tree form developed using different values.

Figure 5:
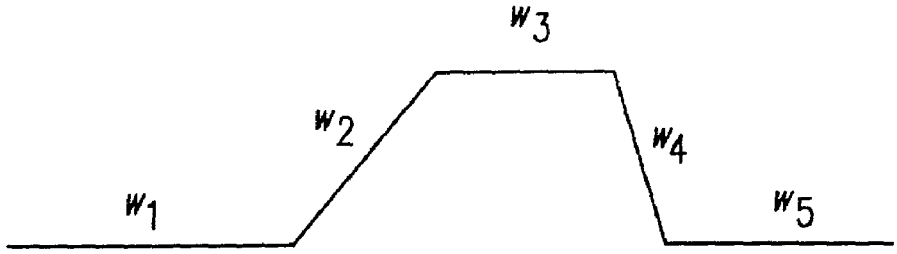
FIG. 5 illustrates an exemplary simple pattern used for generating an optimal antenna configuration.
Figure 6:
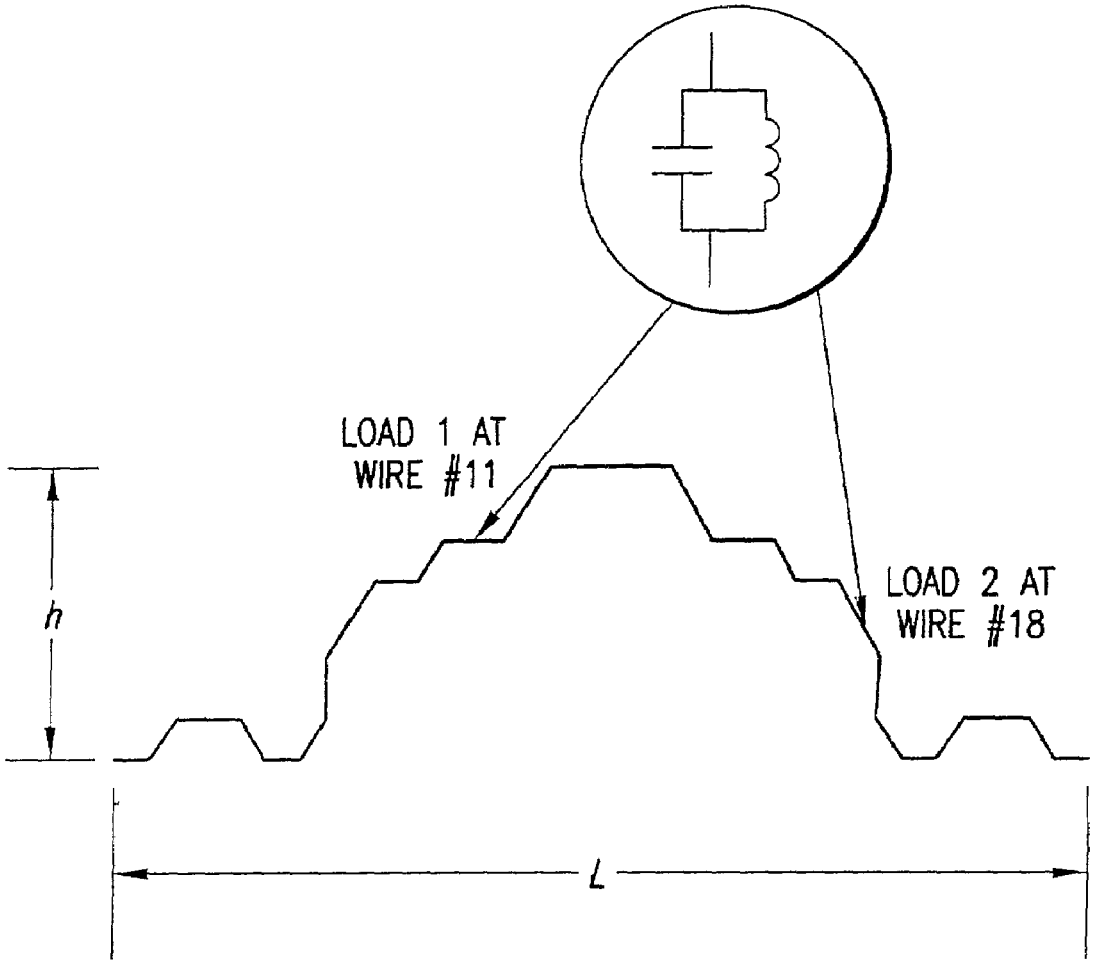
FIG. 6 illustrates an exemplary IFS generated antenna design for optimization by a genetic algorithm according to an exemplary embodiment.

According to an exemplary embodiment, an IFS may be used to create a fractal geometry in a similar manner to that in which the Koch curve is formed. The general shape of an exemplary simple configuration, which may be referred to as a "Werner pattern", is shown in FIG. 5. The set of affine linear transformations for this antenna geometry may be expressed as:

$$w_1(x,y)=(a_1x,\ d_1y) \tag{10}$$

$$w_2(x,y)=(a_2x+b_2y+e_2,\ c_2x+d_2y) \tag{11}$$

$$w_3(x,y)=(a_3x+e_3,\ d_3y+f_3) \tag{12}$$

$$w_4(x,y)=(a_4x+b_4y+e_4,\ c_4x+d_4y+f_4) \tag{13}$$

$$w_5(x,y)=(a_5x+e_5,\ d_5y) \tag{14}$$

and $$W(A)=w_1(A)\cup w_2(A)\cup w_3(A)\cup w_4(A)\cup w_5(A) \tag{15}$$

where $$a_1=d_1=1/S_1 \tag{16}$$

$$a_2=d_2=1/S_2\cos\theta_2 \tag{17}$$

$$b_2=-c_2=-1/S_2\sin\theta_2 \tag{18}$$

$$e_2=1/S_2L \tag{19}$$

$$a_3=d_3=1-(1/S_1+1/S_3+1/S_2\cos\theta_2+1/S_4\cos\theta_4) \tag{20}$$

$$e_3=(1/S_1+1/S_2\cos\theta_2)L \tag{21}$$

$$f_3=(1/S_2\sin\theta_2)L \tag{22}$$

$$a_4=d_4=1/S_4\cos\theta_4 \tag{23}$$

$$b_4=-c_4=1/S_4\sin\theta_4 \tag{24}$$

$$e_4=(1/S_1+1/S_2\cos\theta_2+a_3)L \tag{25}$$

$$f_4=(1/S_2\sin\theta_2)L \tag{26}$$

$$a_5=d_5=1/S_5 \tag{27}$$

$$e_5=(1/S_1+1/S_2\cos\theta_2+a_3+1/S_4\cos\theta_4)L \tag{28}$$

and L is the projected length of the fractal dipole as indicated in FIG. 6.

Here, the geometry of the FAE is uniquely determined by the parameters $S_1$, $S_2$, $S_4$, $S_5$, $\theta_2$, $\theta_4$ and L. These parameters may be encoded into a genetic algorithm (GA) for the purpose of determining the optimal FAE configuration that will best satisfy a particular set of design requirements. Thus, according to an exemplary embodiment, a GA approach may be employed to evolve an optimal design for an FAE, e.g., a multiband FAE.

As an illustrative example, assume that the target frequencies of the antenna are 1225 MHz and 1575 MHz, and the VSWR requirements for both frequencies are to be less than 2. In addition to the VSWR requirement, an aim is to reduce the size of the antenna by over 50% compared to a conventional half-wave dipole at 1225 MHz (the lower frequency). Assume two LC (inductance/capacitance) loads are applied to the antenna so that the VSWR requirement can be satisfied at the higher frequency of 1575 MHz. The genetic algorithm technique may be used in conjunction with an IFS subroutine and a characteristic analysis routine, e.g., a method of moments (MoM) code routine, to systematically optimize the antenna characteristics, e.g., VSWR and gain. The fractal geometry of the antenna, the load component values (L and C) and the load locations are the parameters simultaneously optimized by the GA. The GA provides selected parameters, $S_1$, $S_2$, $S_3$, $S_4$, $\theta_2$, $\theta_4$ and length L, to the fractal generating subroutine that employs the IFS technique to create the FAE geometry. Subsequently, along with the FAE geometry, the LC load component values and the load locations, which are also assigned by the GA, are made available to the MoM code in order to compute the radiation characteristics of the candidate antenna (i.e., VSWR, gain, etc.). The goal here is to achieve low VSWR's for both of the target frequencies. Taking this goal into account, the objective function for the design may be chosen to be:

$$F=\sum_{i=1}^{N_f} VSWR(f_i)-1\ ^2 \tag{29}$$

where $N_f$ is the number of frequencies of interest (in this case, they are 1.225 GHz and 1.575 GHz). Thus, the goal of the genetic algorithm in this example is to generate a configuration for an antenna that produces as low a value for F as possible, indicating that the design exhibits optimal characteristics.

Three design examples using the GA-FAE optimization technique based on the assumptions above are considered. The general fractal antenna structure for all three cases is illustrated in FIG. 6, which is the second iteration of a simple antenna configuration similar to that shown in FIG. 5, generated by applying an IFS. In FIG. 6, a fractal antenna with capacitive and inductive loads represented at two points is shown.

The antenna structure in all three cases contains 25 wires as illustrated in FIG. 6. The antenna structure parameters, load component values and load locations, which are all selected by the GA, are listed in Table 1 for each of the three designs considered. The first design has a projected length of L=9 cm and a VSWR of 1.04 and 1.14 for 1.225 GHz and 1.575 GHz, respectively. The second design has a projected length of L=7 cm and a VSWR of 1.33 and 1.10 for 1.225 GHz and 1.575 GHz, respectively. Finally, the third design has a projected length of only L=5.5 cm with a corresponding VSWR of 1.94 and 1.79 at 1.225 GHz and 1.575 GHz, respectively. This last case represents an overall size reduction of 55%.

TABLE 1

The GA selected parameters and the corresponding VSWRs

| | Antenna Structure Parameters | | | | | | Load Component Values | | | | Load Location | | Projected Length | | VSWR | |
|---|---|---|---|---|---|---|---|---|---|---|---|---|---|---|---|---|
| | | | | | $\theta_2$ | $\theta_4$ | $L_1$ | $L_2$ | $C_1$ | $C_2$ | wire # | | L | h | 1.225 | 1.575 |
| Design | $S_1$ | $S_2$ | $S_4$ | $S_5$ | (degrees) | | (nH) | | (pF) | | 1 | 2 | (cm) | | GHz | GHz |
| 1 | 5.43 | 4.83 | 4.99 | 5.46 | 44.29 | 46.23 | 15.44 | 12.05 | 0.66 | .33 | 5 | 25 | 9 | 1.75 | 1.04 | 1.14 |
| 2 | 5.26 | 4.74 | 4.55 | 5.45 | 47.36 | 44.96 | 19.5 | 17.95 | 0.10 | .81 | 19 | 23 | 7 | 1.49 | 1.33 | 1.10 |
| 3 | 5.90 | 4.70 | 4.40 | 5.30 | 50.44 | 46.20 | 12.51 | 15.87 | 0.54 | .93 | 16 | 22 | 5.5 | 1.22 | 1.94 | 1.79 |

Figure 7:
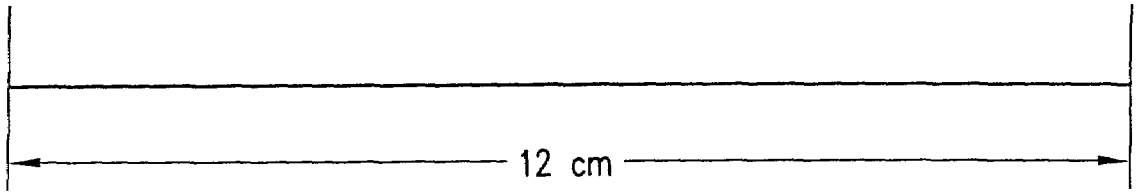
FIGS. 7 and 8 illustrate a conventional half-wave dipole and an exemplary genetically engineered dipole, respectively.
Figure 8:
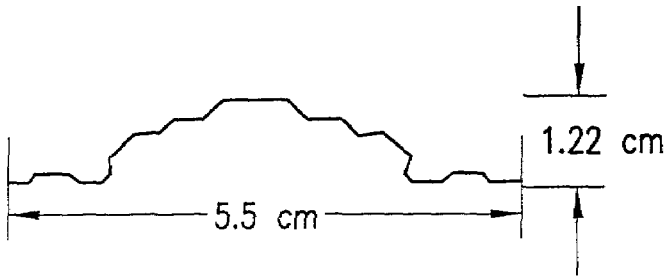

FIG. 7 illustrates a conventional half-wave dipole at 1.225 GHz, while FIG. 8 shows the geometry of the GA optimized FAE for the last case described in Table 1. This comparison clearly demonstrates the degree of miniaturization that can be achieved through the use of the new GA-FAE design optimization technique.

The genetic algorithm technique described above has been successfully developed for use in conjunction with an IFS approach for generating fractal geometries and a computational electromagnetics analysis code based on the method of moments to systematically optimize the performance characteristics of FAE's. For the three examples considered here, the VSWR's of the optimized FAE's were less than 2 at each of the specified target frequencies. It was also shown that the projected length of a fractal dipole may be reduced by as much as 55% compared to a conventional dipole by the optimal choice of an antenna shape, as well as load locations and associated component values.

Figure 9:
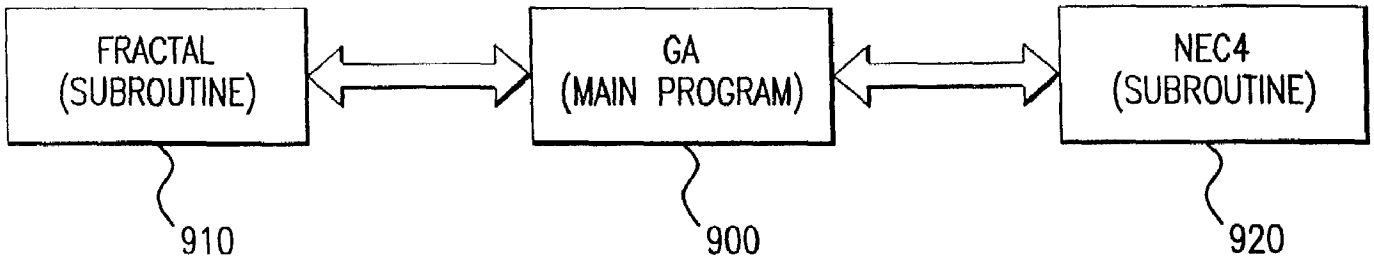
FIG. 9 schematically shows an exemplary system for generating an antenna configuration according to an exemplary embodiment.

FIG. 9 schematically represents elements of an optimization tool according to an exemplary embodiment. FIG. 9 shows the main GA program, a geometry-generating subroutine for generating an antenna pattern, e.g., an IFS for generating a fractal antenna configuration, and a subroutine for determining the radiation pattern of the antenna, e.g., a Method of Moments (MoM) subroutine, such as the Numerical Electromagnetic Code 4 (NEC4) subroutine, or a finite elements subroutine. These routines may be executed on a microprocessor in a conventional personal computer 1000, such as that shown in FIG. 10.

According to an exemplary embodiment, the GA program is used in conjunction with a fractal geometry-generating subroutine and the NEC4 code to optimize the radiation characteristics of an antenna (e.g., VSWR, gain, etc.) for the frequencies of interest. For example, the IFS generates a fractal pattern based on a simple motif, the radiation pattern of that fractal is determined using the NEC4, and the GA adapts the geometry of the pattern based on the radiation characteristics, also attempting to optimize the geometry. Alternatively, the IFS may generate a fractal pattern of a GA optimized simple pattern, and the GA may be applied to the resulting fractal again, depending on the radiation characteristics.

The method of moments subroutine provides a tool for accurately analyzing the radiation characteristics of a given member of the population of candidate antenna configurations produced by the GA. The radiation characteristics of each antenna design in the population are determined by performing a numerically-rigorous MoM simulation. These candidate antenna design population members are then ranked according to how well they meet the desired specifications. The population is then evolved by the GA into the next generation by applying the appropriate genetic operators, such as crossover and mutation. Each member of the new population is then evaluated via MoM and ranked according to fitness. The process is repeated until the GA eventually converges to the optimal antenna configuration.

Figure 10:
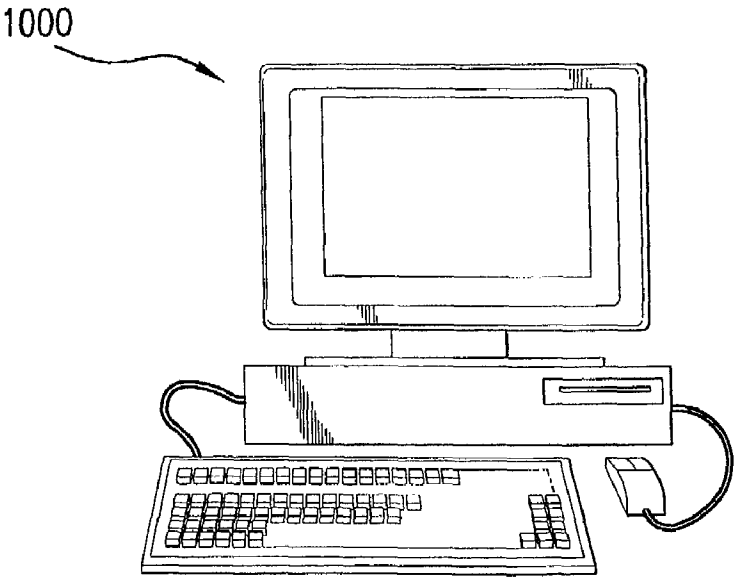
FIG. 10 illustrates an exemplary system in which the invention may be implemented.

The desired characteristics may be predetermined (e.g., default characteristics may be used) or may be input via the user interface at the computer 1000 shown in FIG. 10. Also, the initial pattern may be predetermined (i.e., a default pattern may be used) or may be designated by a user using the user interface. The initial pattern may be selected from predetermined patterns or designated depending on the desired characteristics. Results of the optimization may also be viewed, e.g., at the terminal included in the personal computer shown in FIG. 10. A user may use the optimization results to construct an antenna.

Figure 11:
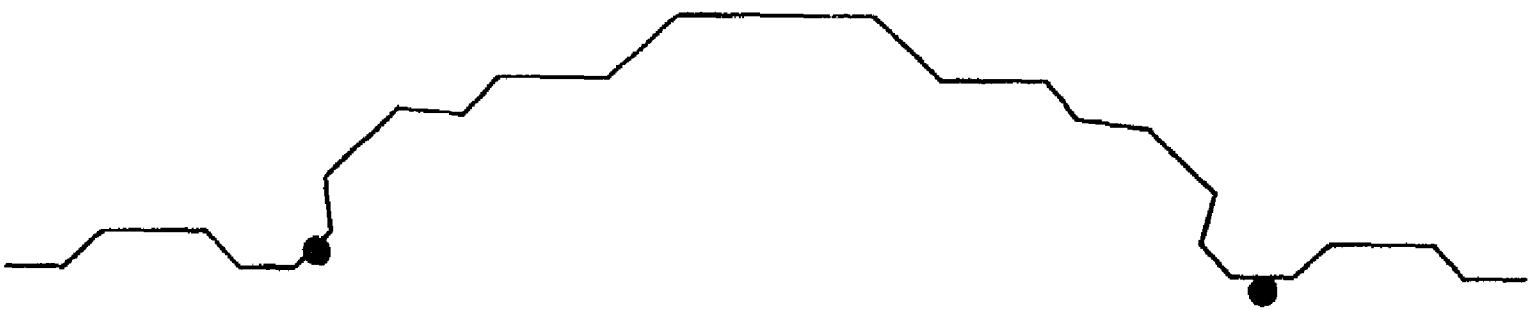
FIGS. 11-24 show a progressively shrinking fractal antenna configuration in comparison with a conventional dipole.
Figure 12:
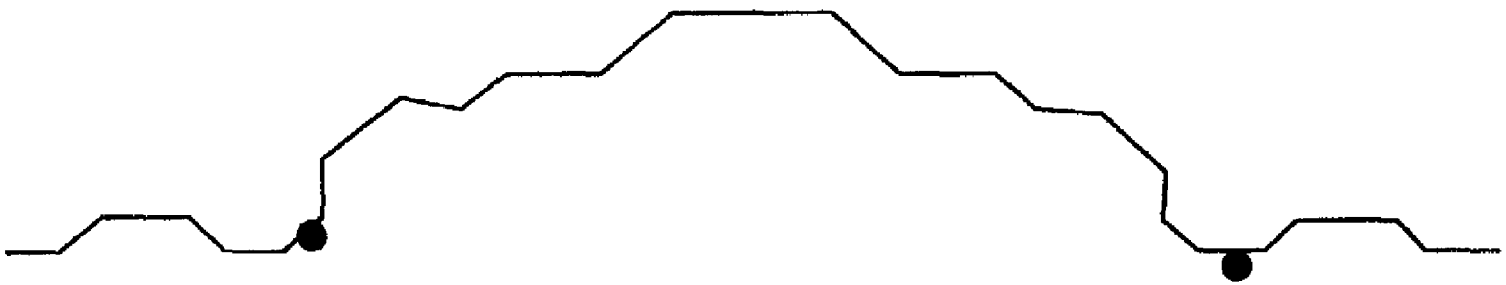
Figure 13:
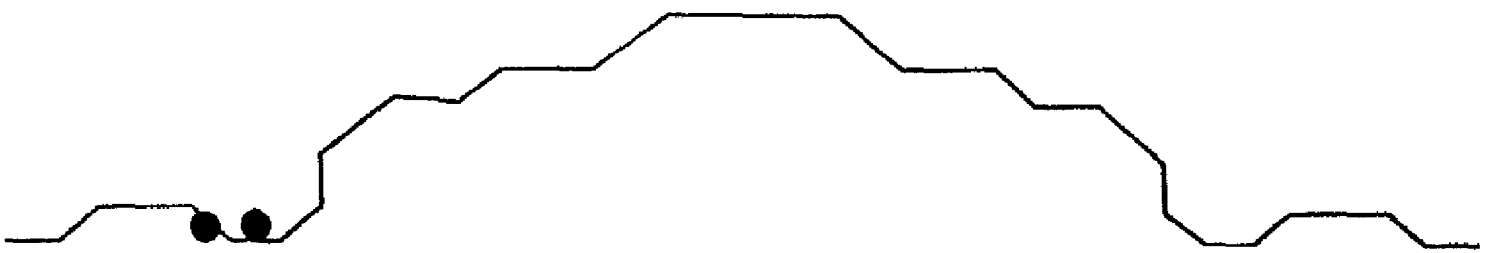
Figure 14:
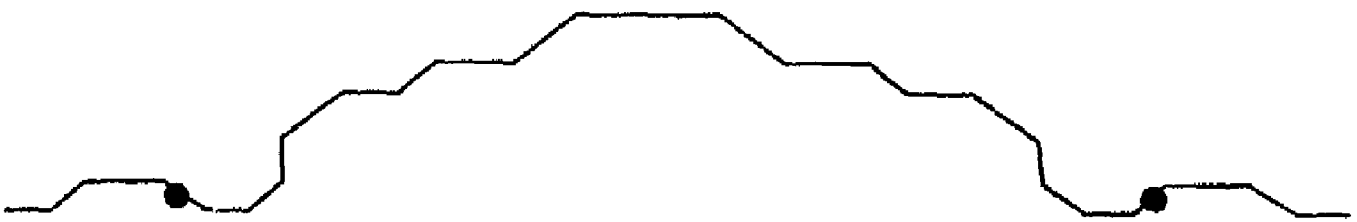
Figure 15:
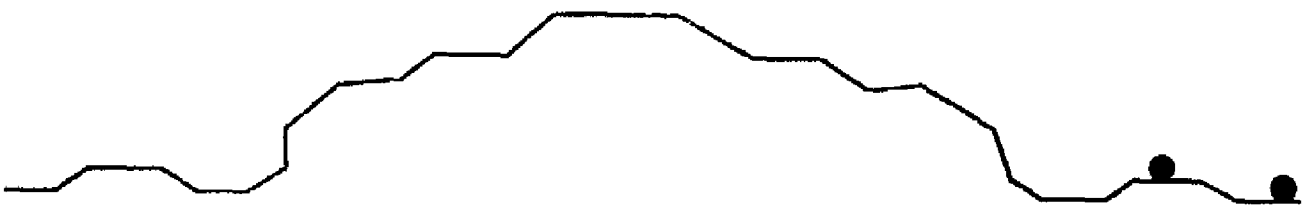
Figure 16:
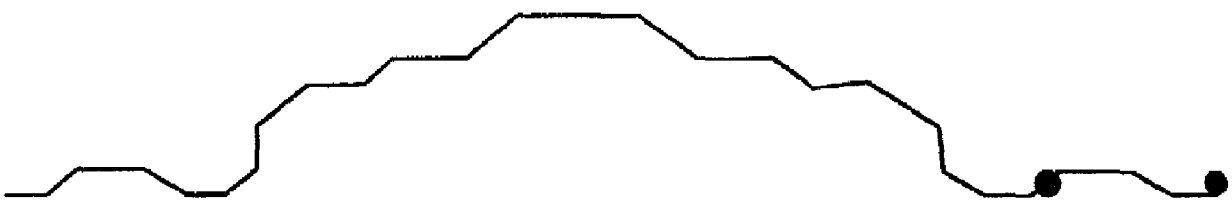
Figure 17:
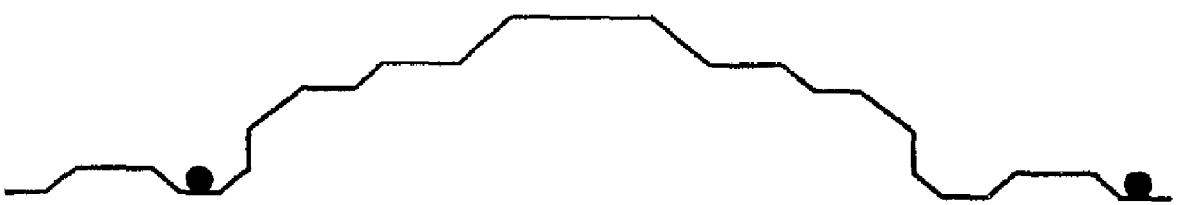
Figure 18:
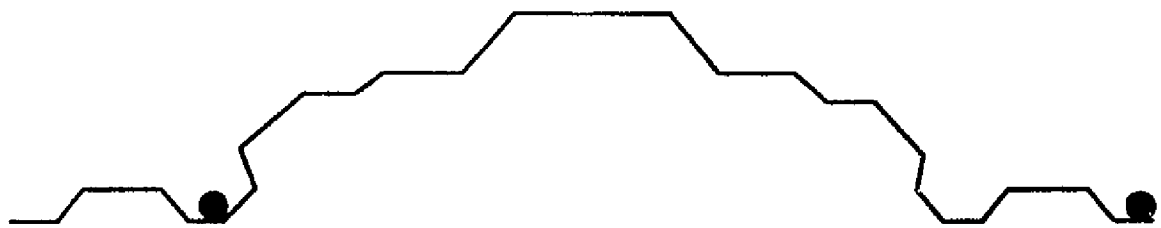
Figure 19:
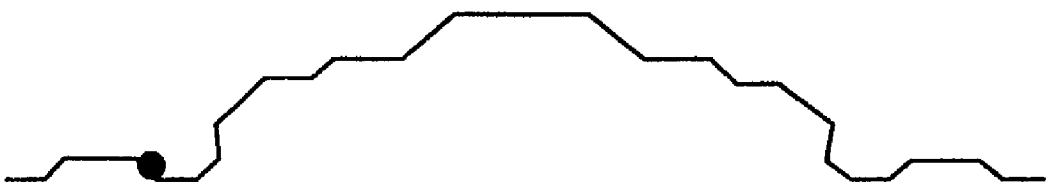
Figure 20:
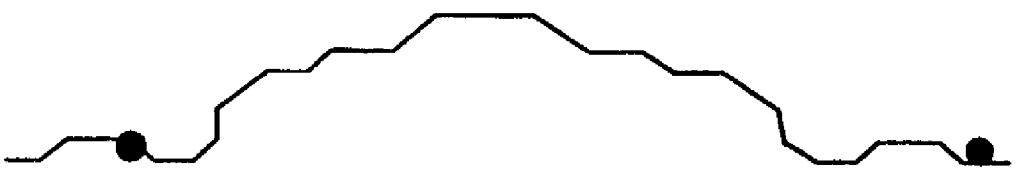
Figure 21:
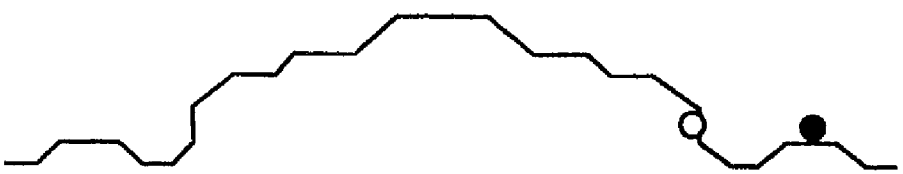
Figure 22:
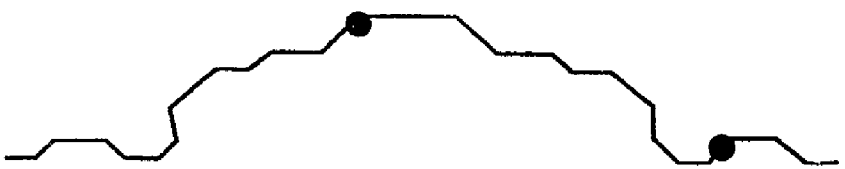
Figure 23:
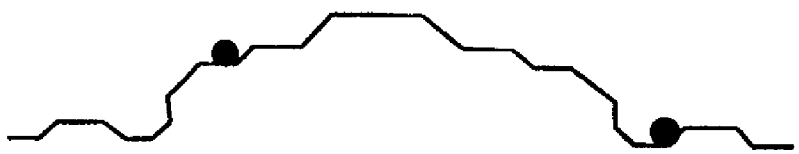
Figure 24:
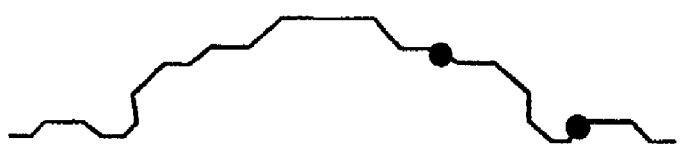
Figure 25:
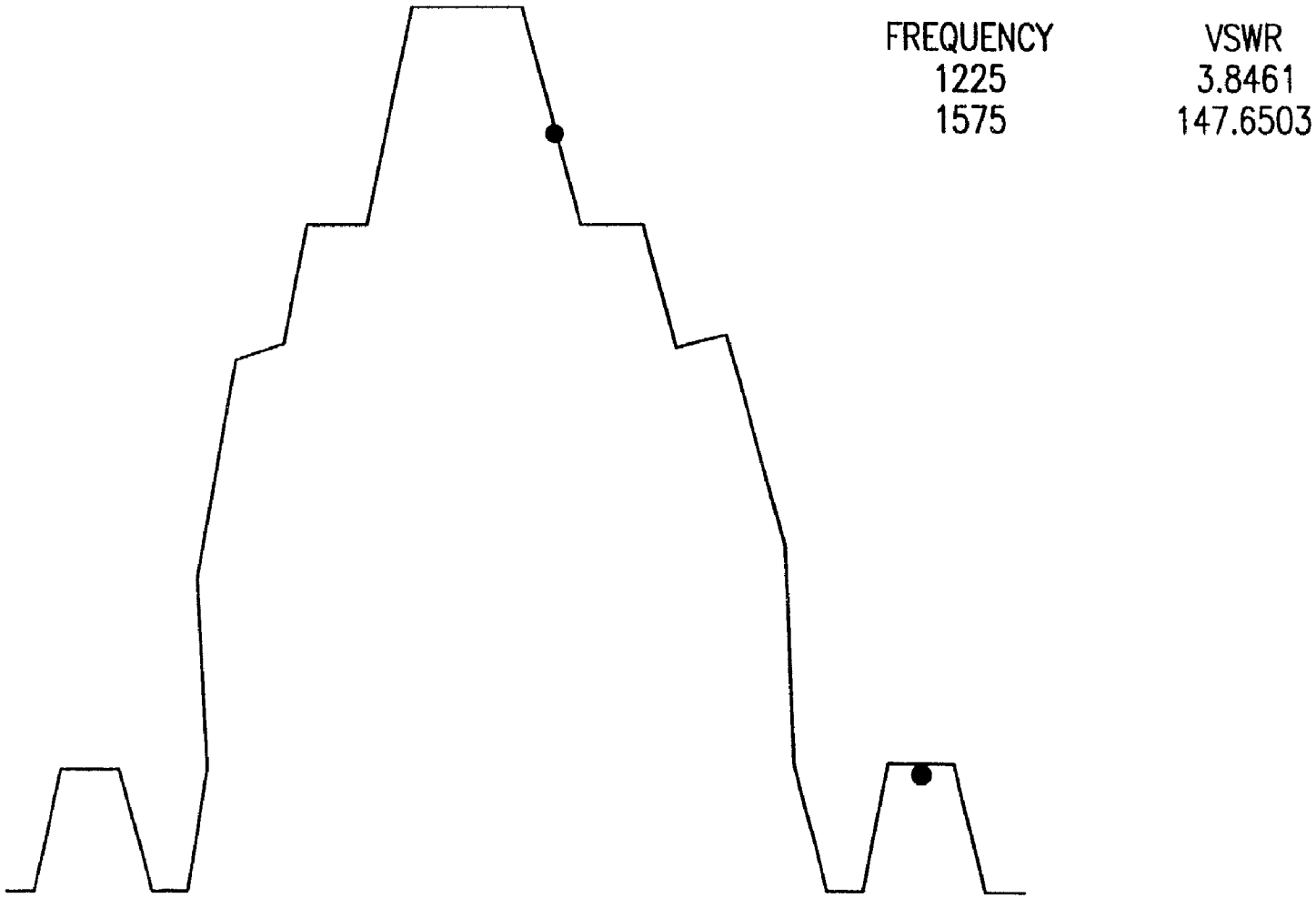
FIGS. 25-38 show the changing shape and load locations for an exemplary fractal antenna with a fixed projected length of 5.5 cm.
Figure 26:
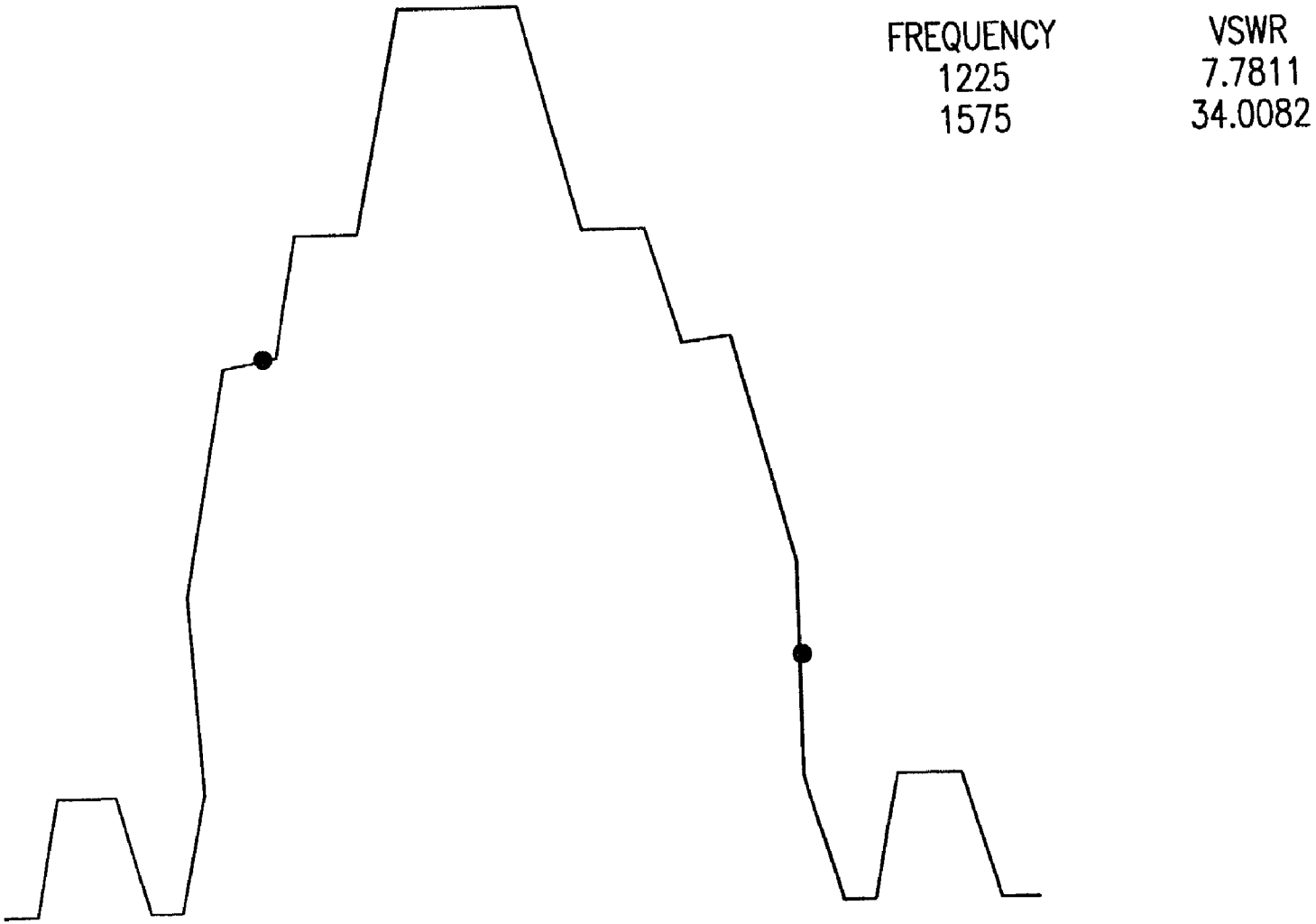
Figure 27:
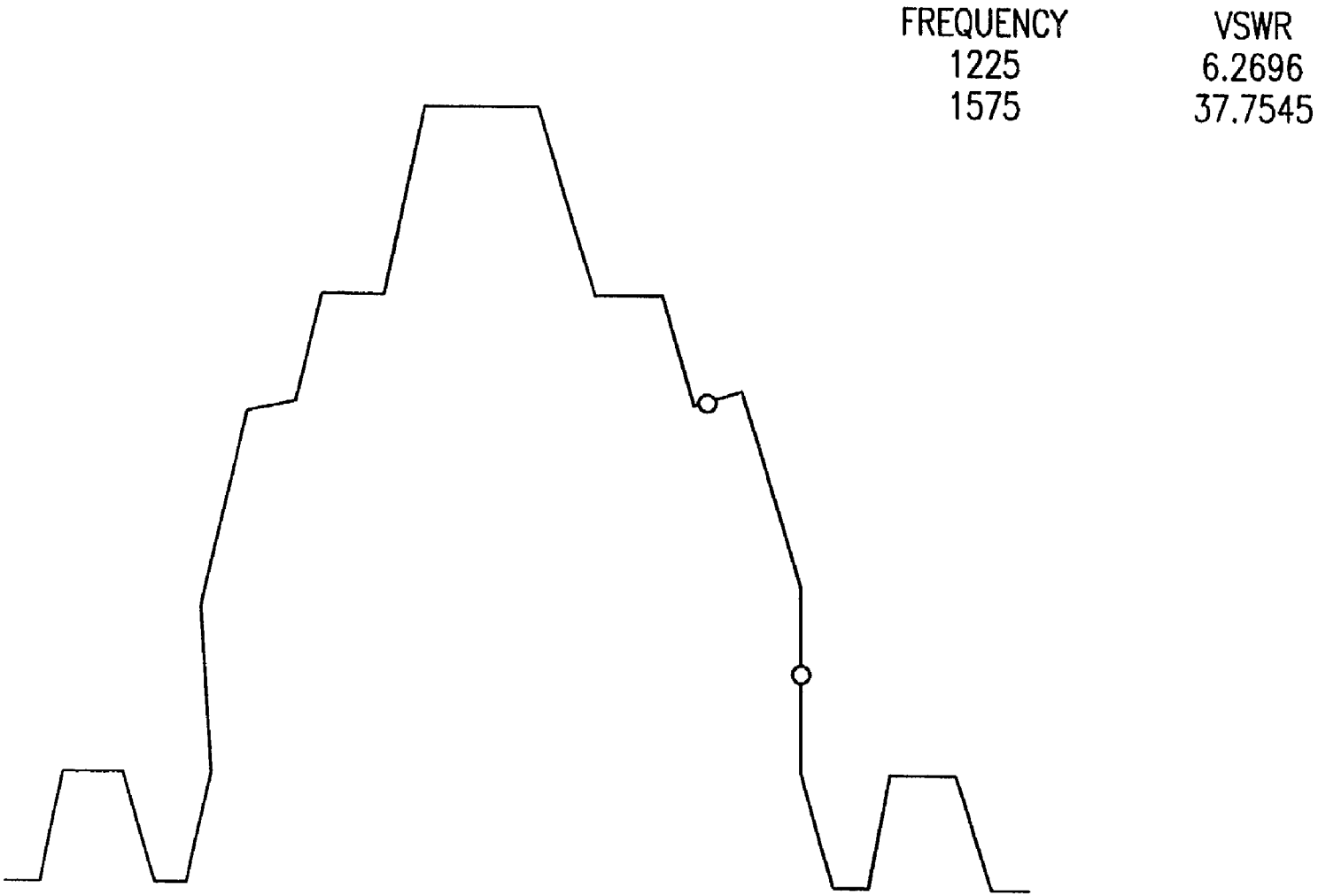
Figure 28:
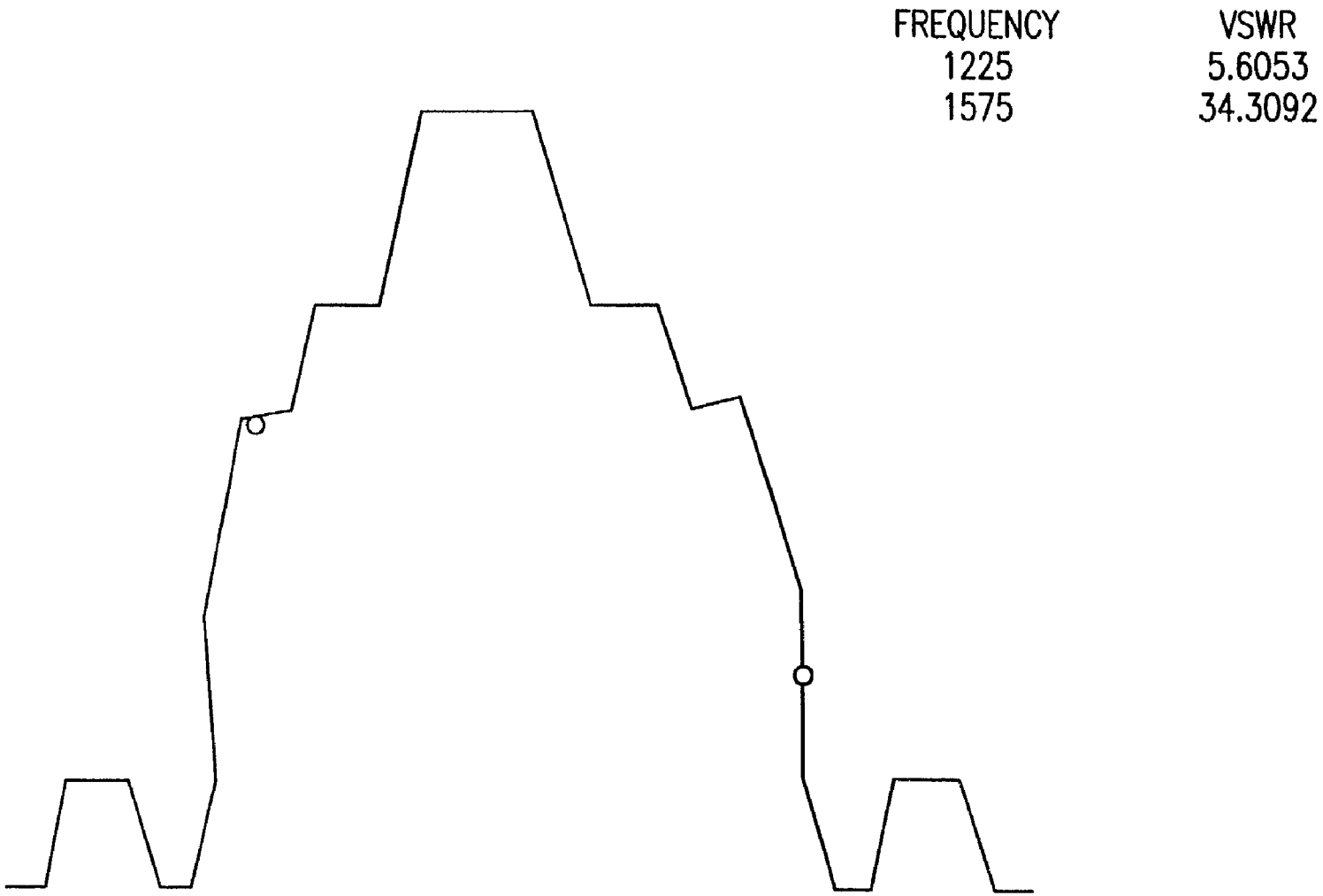
Figure 29:
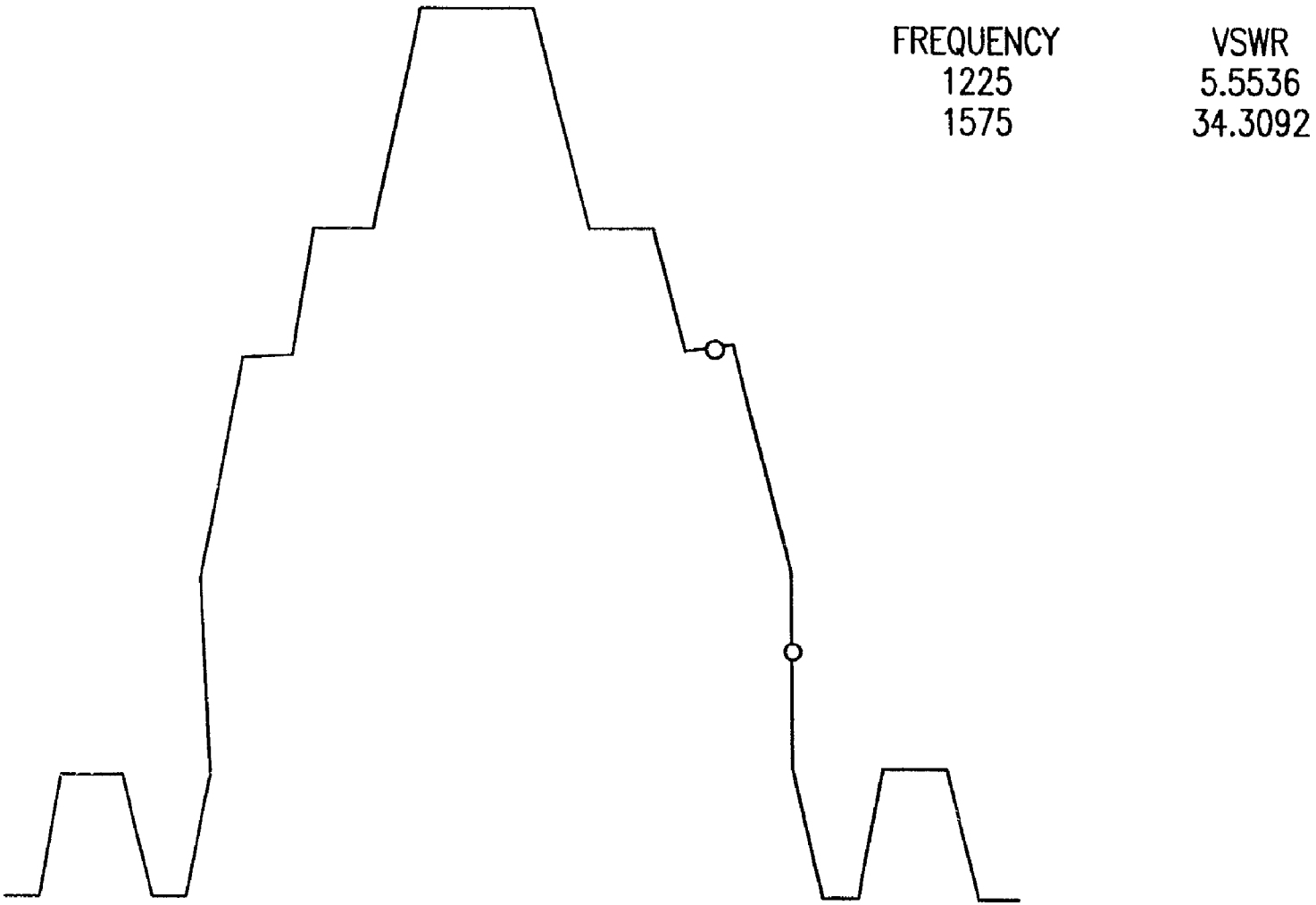
Figure 30:
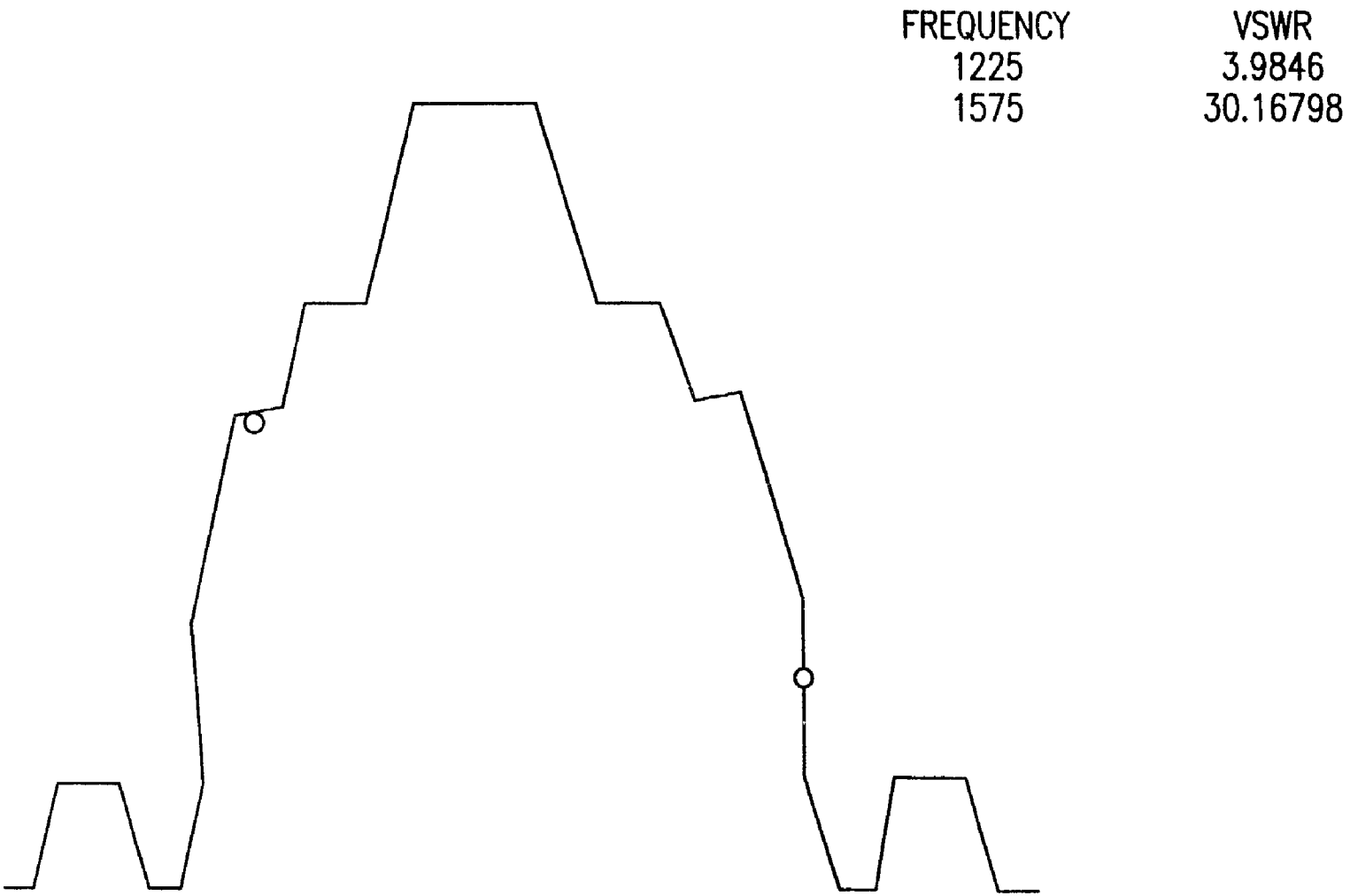
Figure 31:
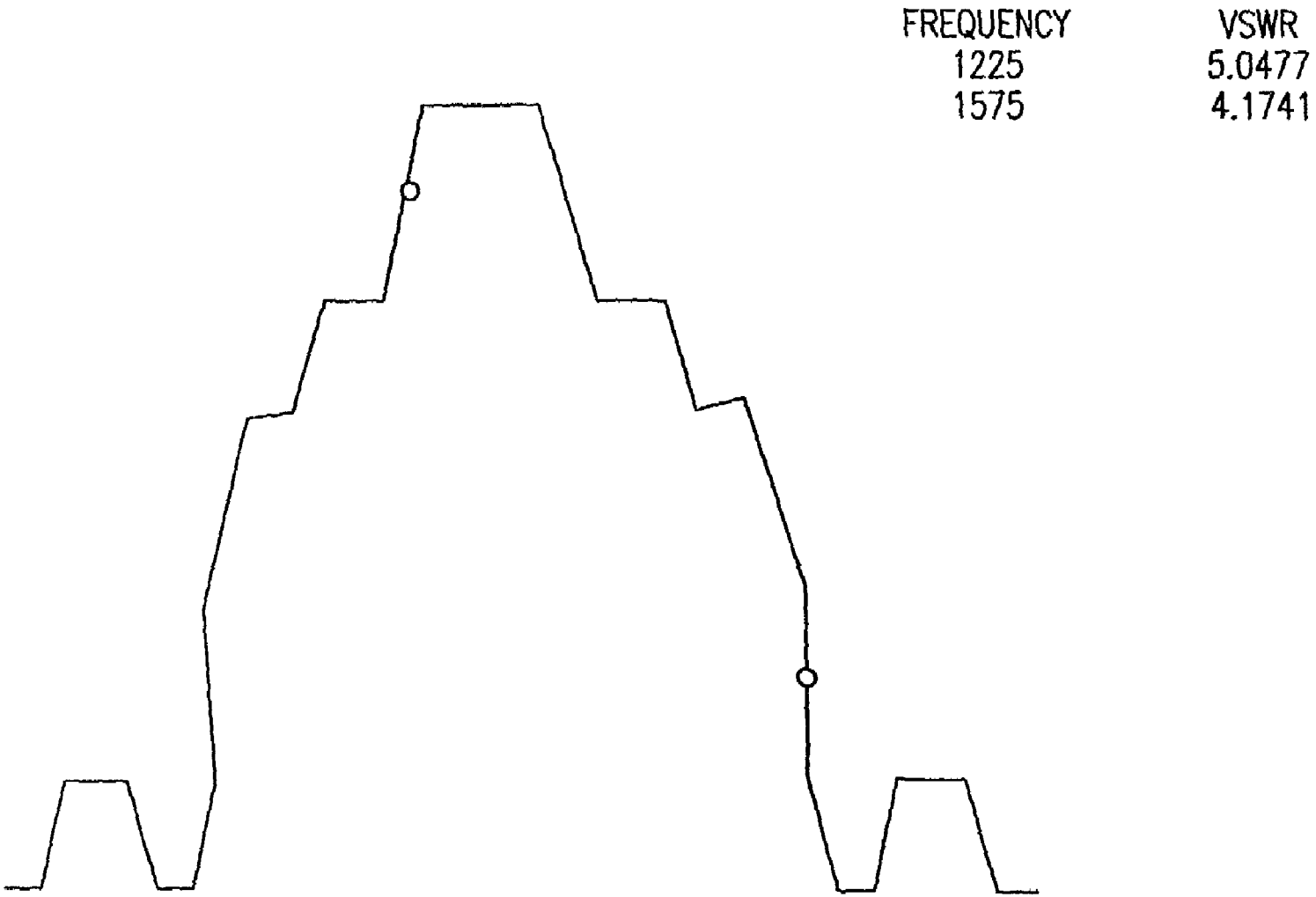
Figure 32:
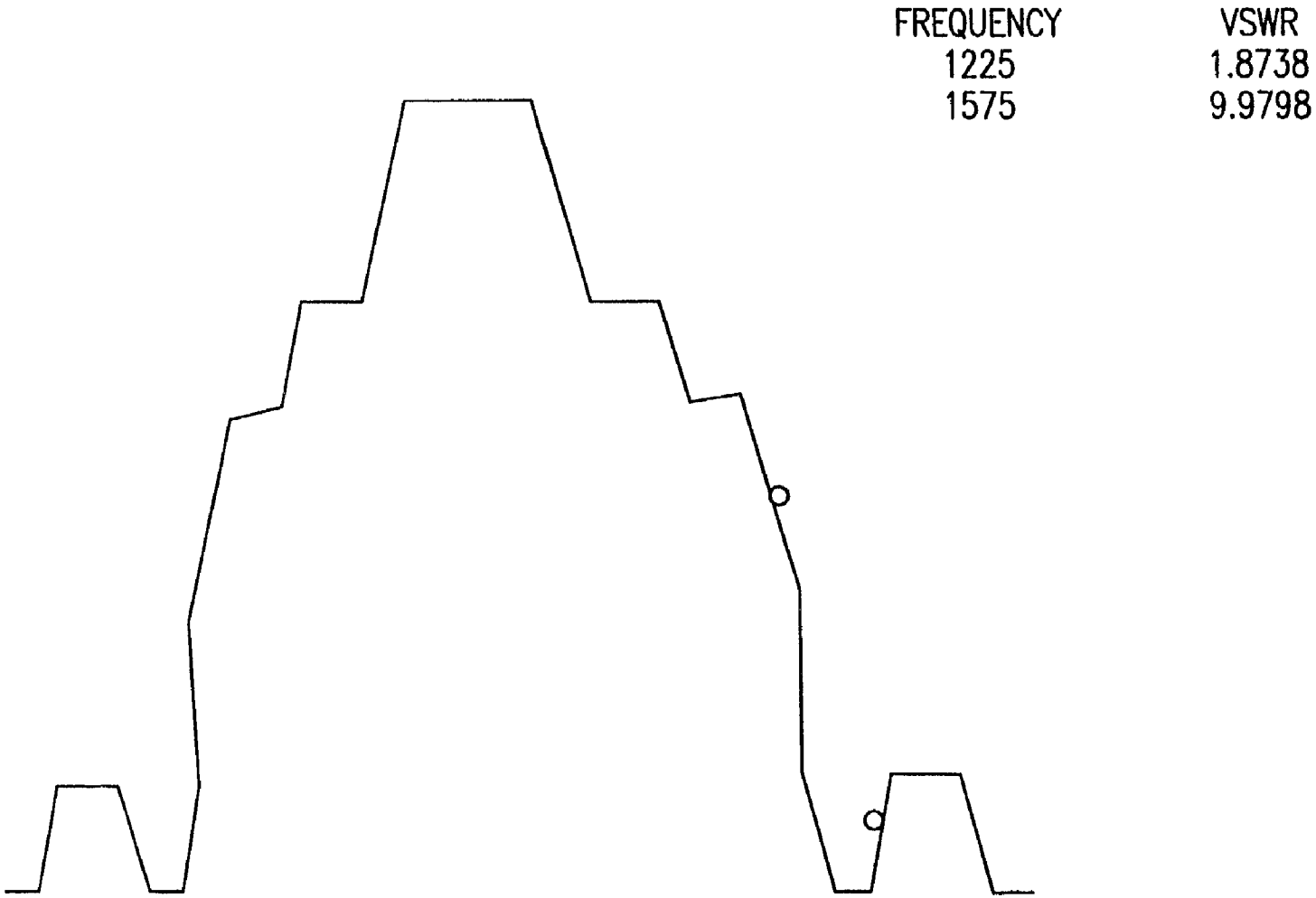
Figure 33:
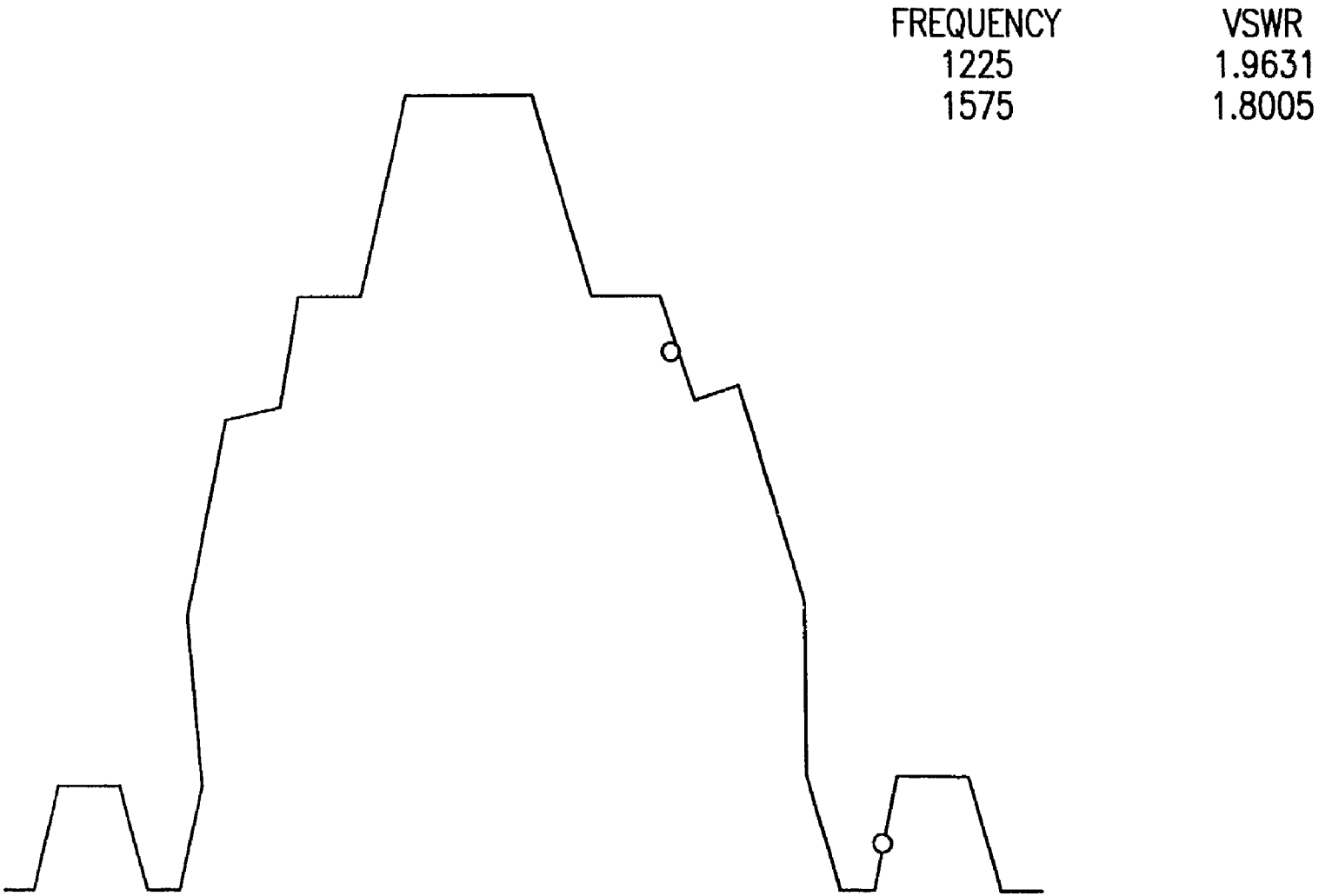
Figure 34:
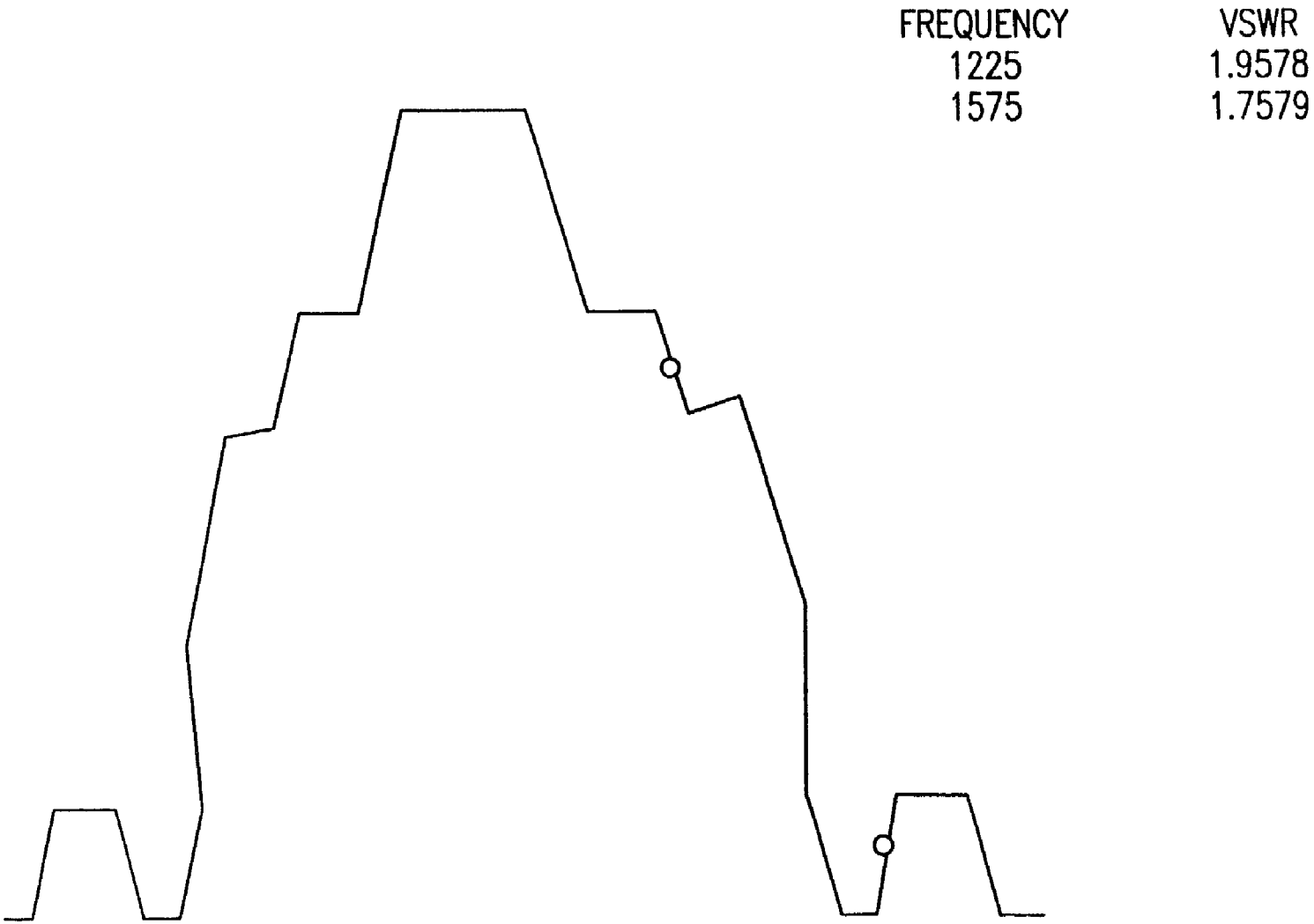
Figure 35:
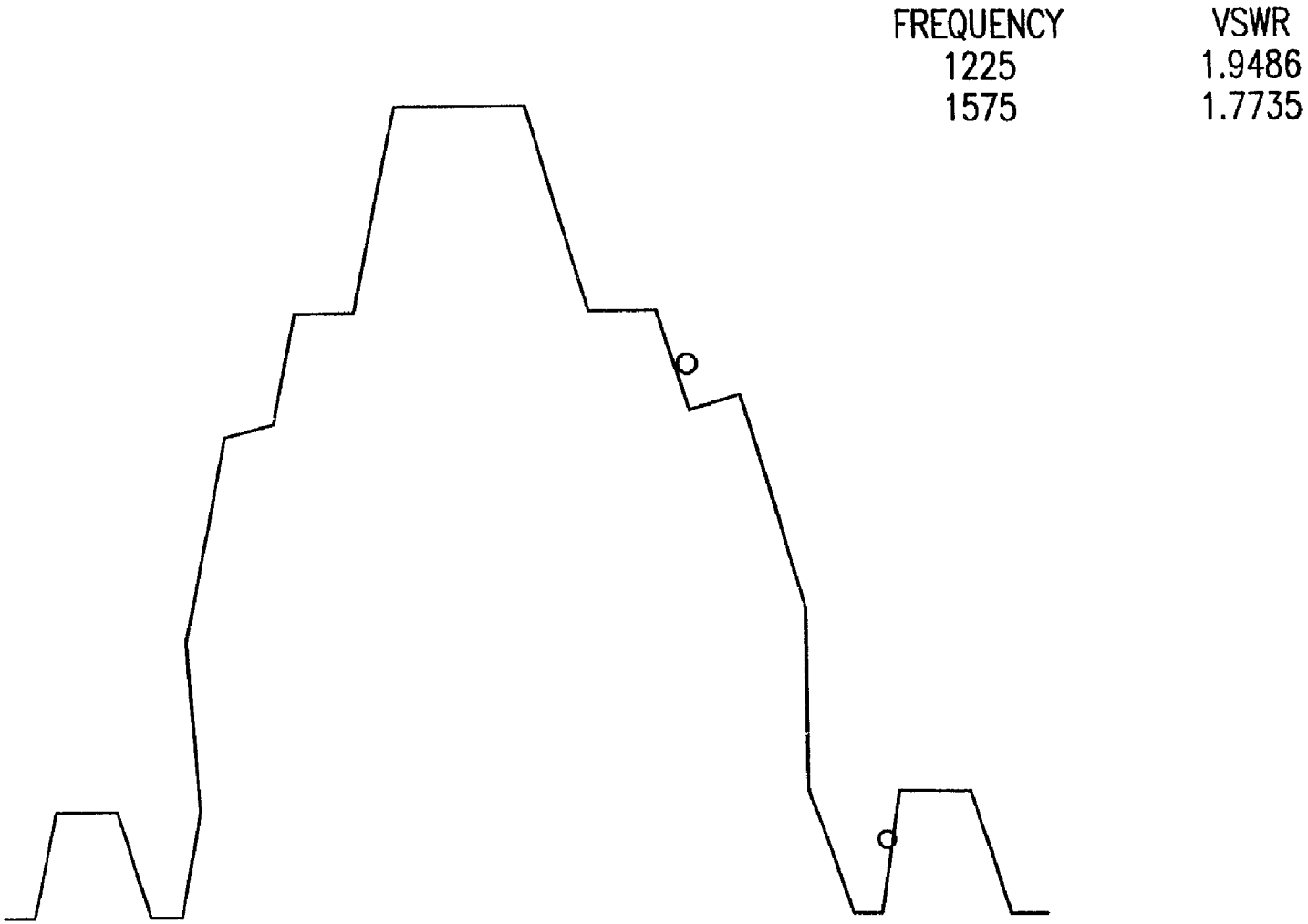
Figure 36:
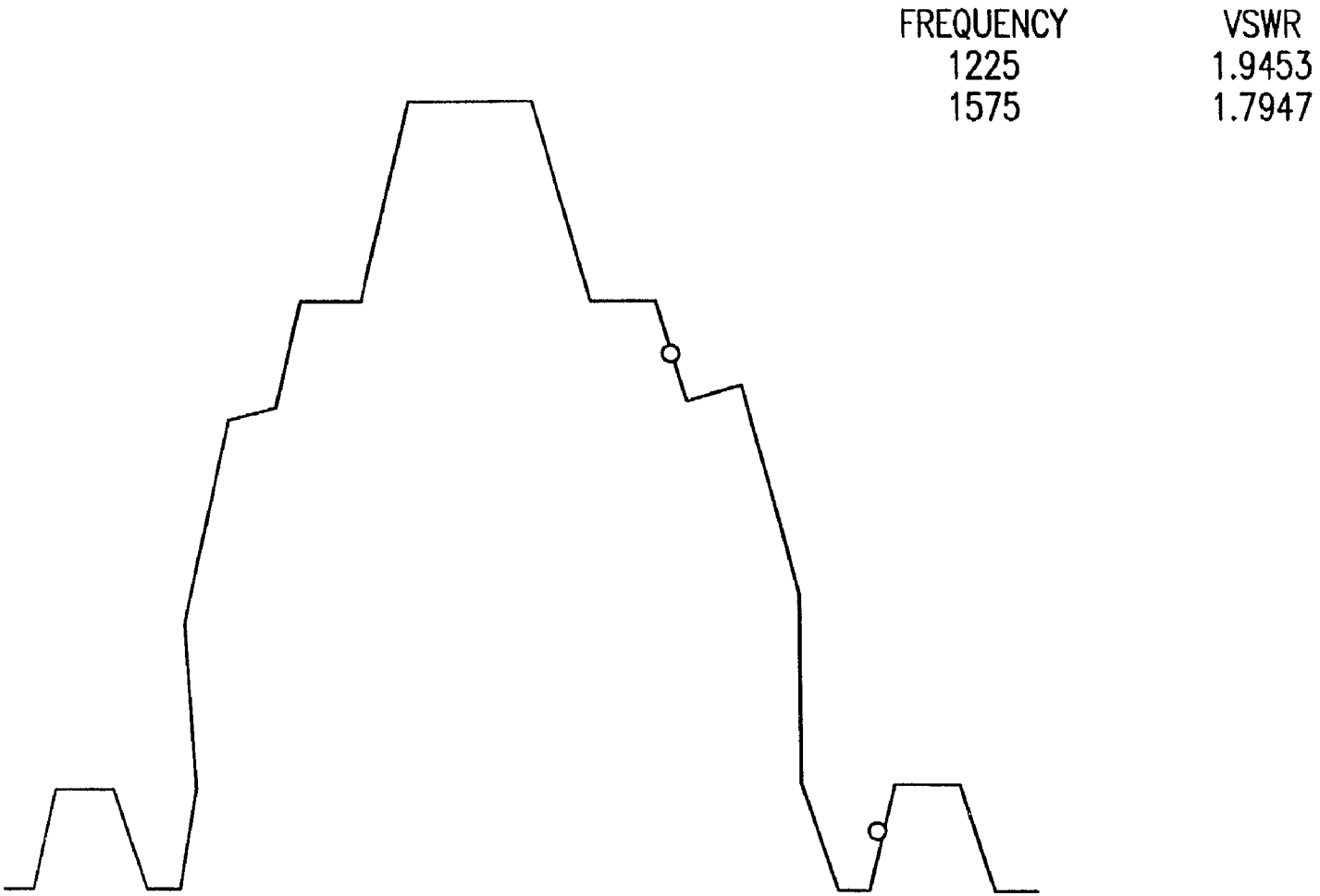
Figure 37:
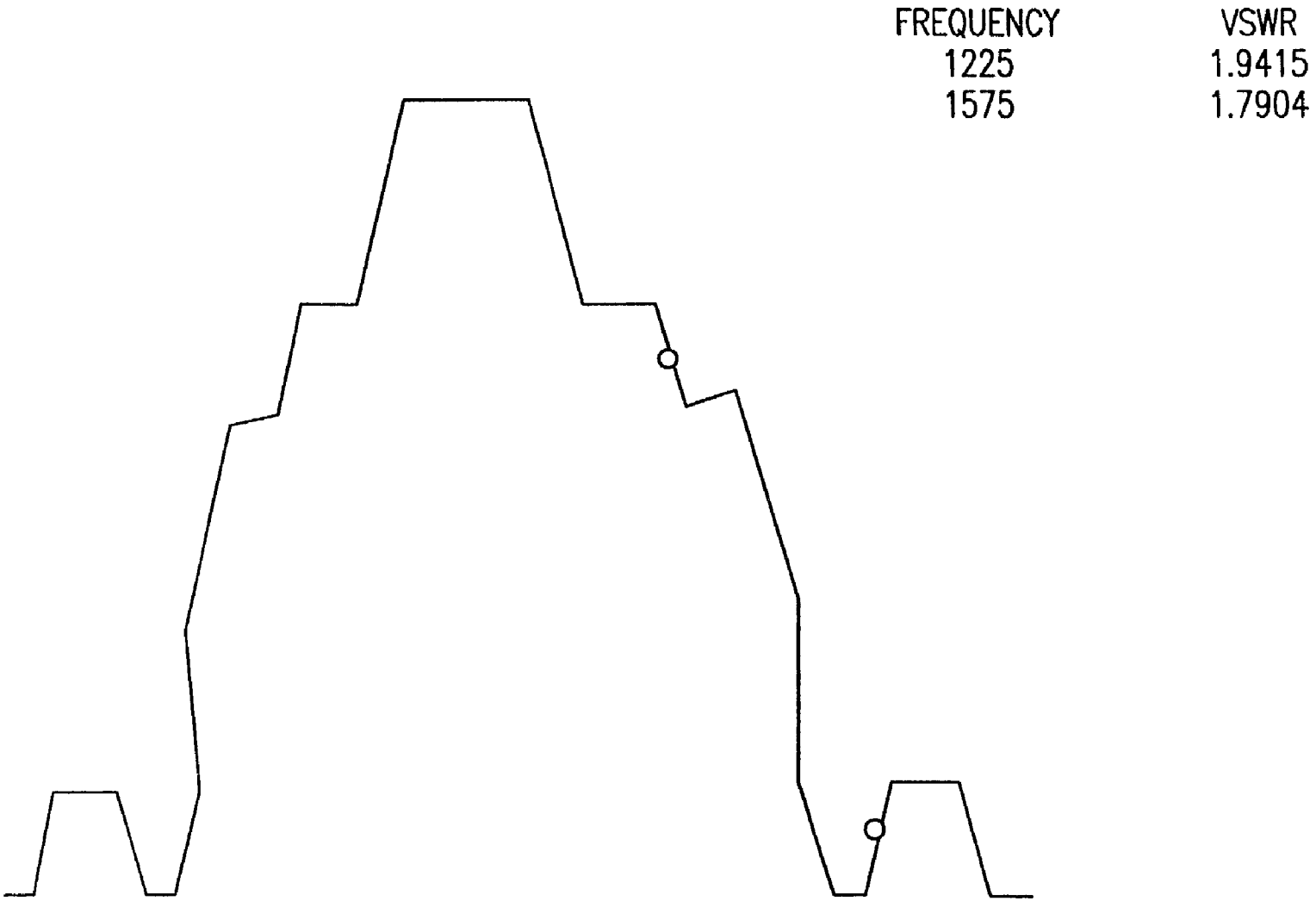
Figure 38:
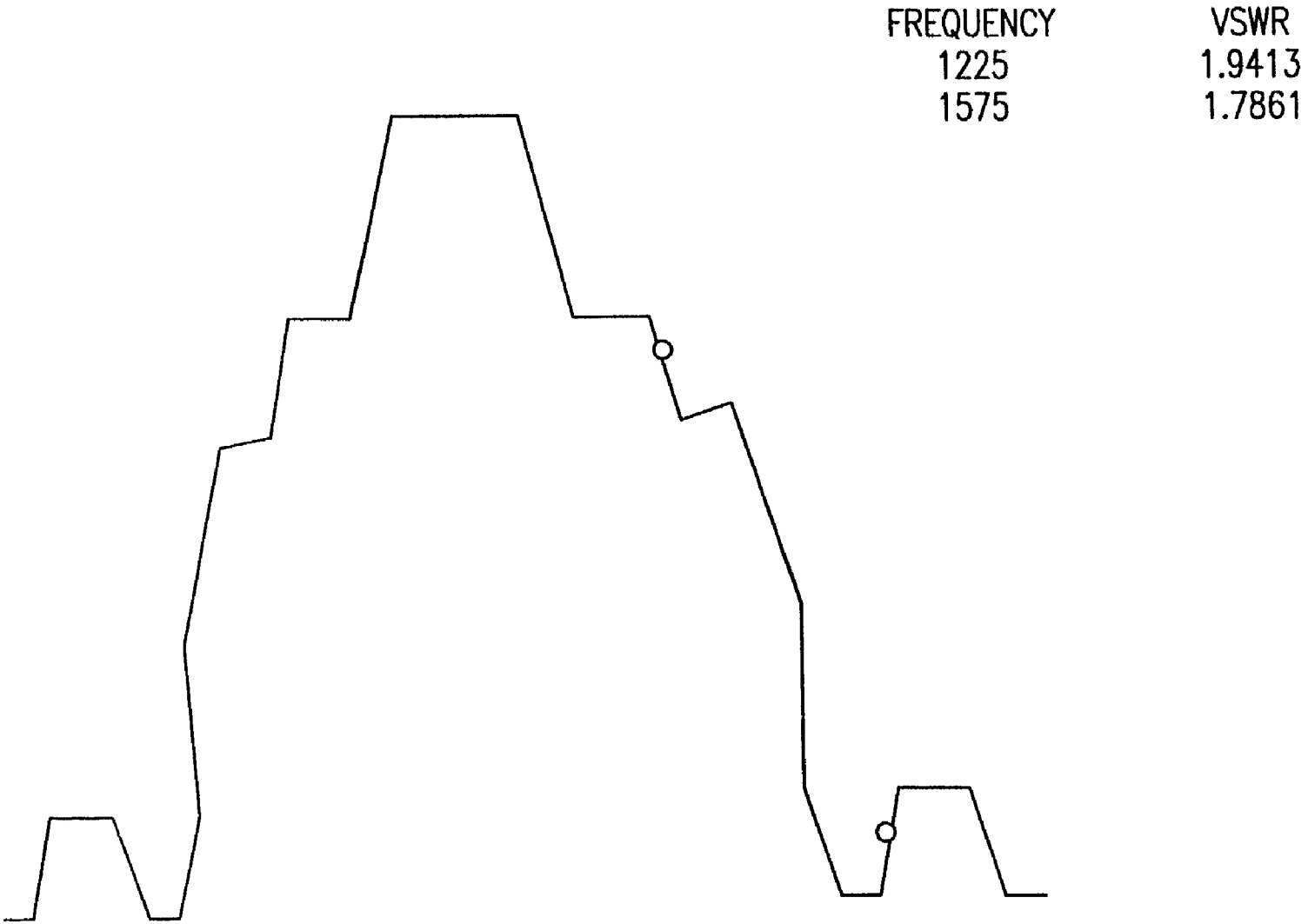

FIGS. 11-24 illustrate exemplary stages in optimizing a dipole antenna. In these figures, the load locations are shown as small circles. The inductive and capacitive loads are shown in the drawings for the frequencies shown in the drawings. As can be seen from these figures, the antenna pattern and load locations undergo several iterations, to achieve the optimal pattern and load arrangement shown in FIG. 24. Comparing the final iteration in FIG. 24 with the initial pattern shown in FIG. 11, the location of the loads is the biggest change. This results in a small degradation in VSWR from 1.3383 to 1.9413 at 1225 MHz and from 1.2872 to 1.7861 at 1575 MHz. However, the pattern in FIG. 25 is much smaller than that in FIG. 12, i.e. 5.5 cm compared to 12 cm.

FIGS. 25-38 show various stages in the GA optimization process of a loaded fractal dipole with a fixed projected length. In this case, the location of the loads is not changed a great deal, and the length of the pattern is not changed. However, the improvement in VSWR is tremendous, from 3.8461 to 1.9413 at 1225 MHz and from 147.6503 to 1.7861 at 1575 MHz.

As can be seen from the examples above, fractal antenna engineering concepts may be successfully combined with genetic algorithms to develop a powerful design optimization tool. Although particular fractal patterns are described above for illustrative purposes, the optimization tool may be applied to any optimize any fractal pattern.

According to exemplary embodiments, a new design for miniature multiband loaded fractal antennas is based on the introduction of loads to fractalized wire antenna structures. The fractalization allows for miniaturization. The introduction of loads allows more degrees of freedom in the design to introduce desired multiband properties as well as to realize size reduction that has not been possible to achieve with conventional unloaded designs of fractal antennas. These new designs have been realized using a genetic algorithm technique that simultaneously optimizes geometry of a fractal antenna, locations of loads, component values of loads, and projected length of the fractal. A 30%-55% size reduction may be achieved by optimizing the fractalization of a given antenna. This is particularly suitable for the design of miniature fractal antennas, e.g., miniature global positioning system (GPS) fractal antennas.

According to the embodiments described above, an IFS is applied to a simple pattern to generate a fractal pattern to which a genetic algorithm is applied. However, it will be appreciated that the pattern to which the genetic algorithm is applied need not be restricted to fractal shapes. The pattern may be semi-fractal, e.g., containing patterns that are similar but not necessarily having the same relative angles or proportions, or random, e.g., containing randomly selected segments. This provides more freedom for the GA to optimize its performance. To see why this is the case, consider the following.

Figure 39:
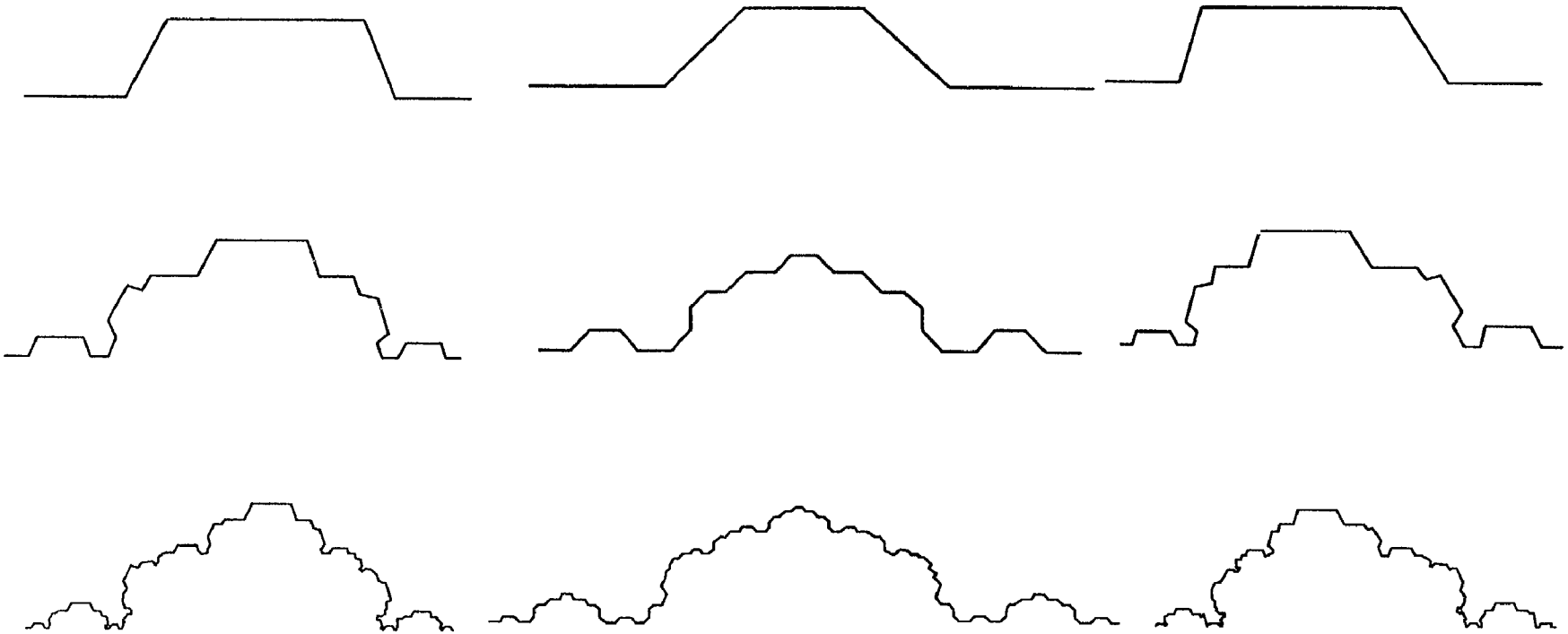
FIG. 39 illustrates exemplary geometries that may result from GA optimization.

In fractal antennas, the resulting wire or microstrip antenna geometries are restricted to being either strictly self-similar or self-affine. FIG. 39 shows three typical examples of the type of fractal geometries that might be evolved via the GA optimization procedure. These structures, which are generated by applying an iterative fractal process to a motif and then applying a genetic algorithm to the generated fractal pattern, may be referred to as "Werner fractals" to differentiate them from standard fractals, such as the Koch fractals that are shown in FIG. 1.

According to another embodiment, rather than applying an IFS to a simple pattern to generate a fractal pattern, a semi-fractal process may be applied to a simple pattern to generate a semi-fractal pattern to which the GA is applied. The semi-fractal process may be performed as a subroutine in the system shown in FIG. 9. According to this embodiment, the antenna structure itself will not be restricted to fractal shapes, resulting in more freedom for the GA to optimize its performance.

Figure 40:
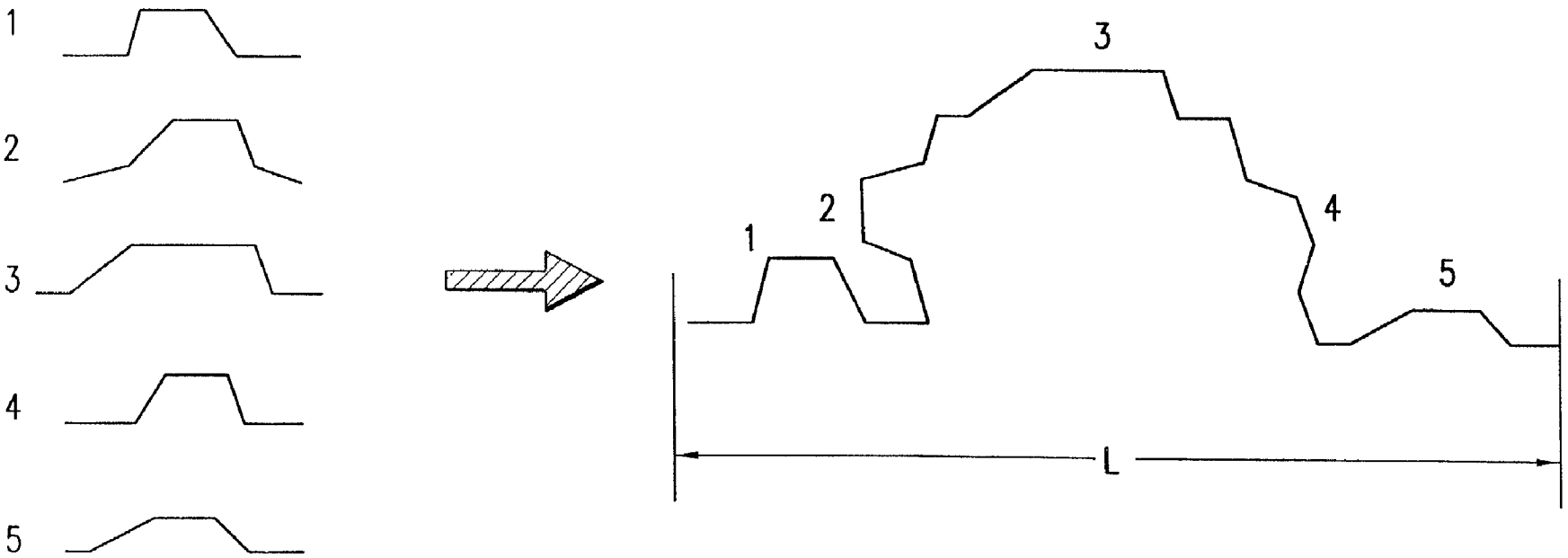
FIG. 40 illustrates a semi-fractal iterated process according to an exemplary embodiment.
Figure 41:
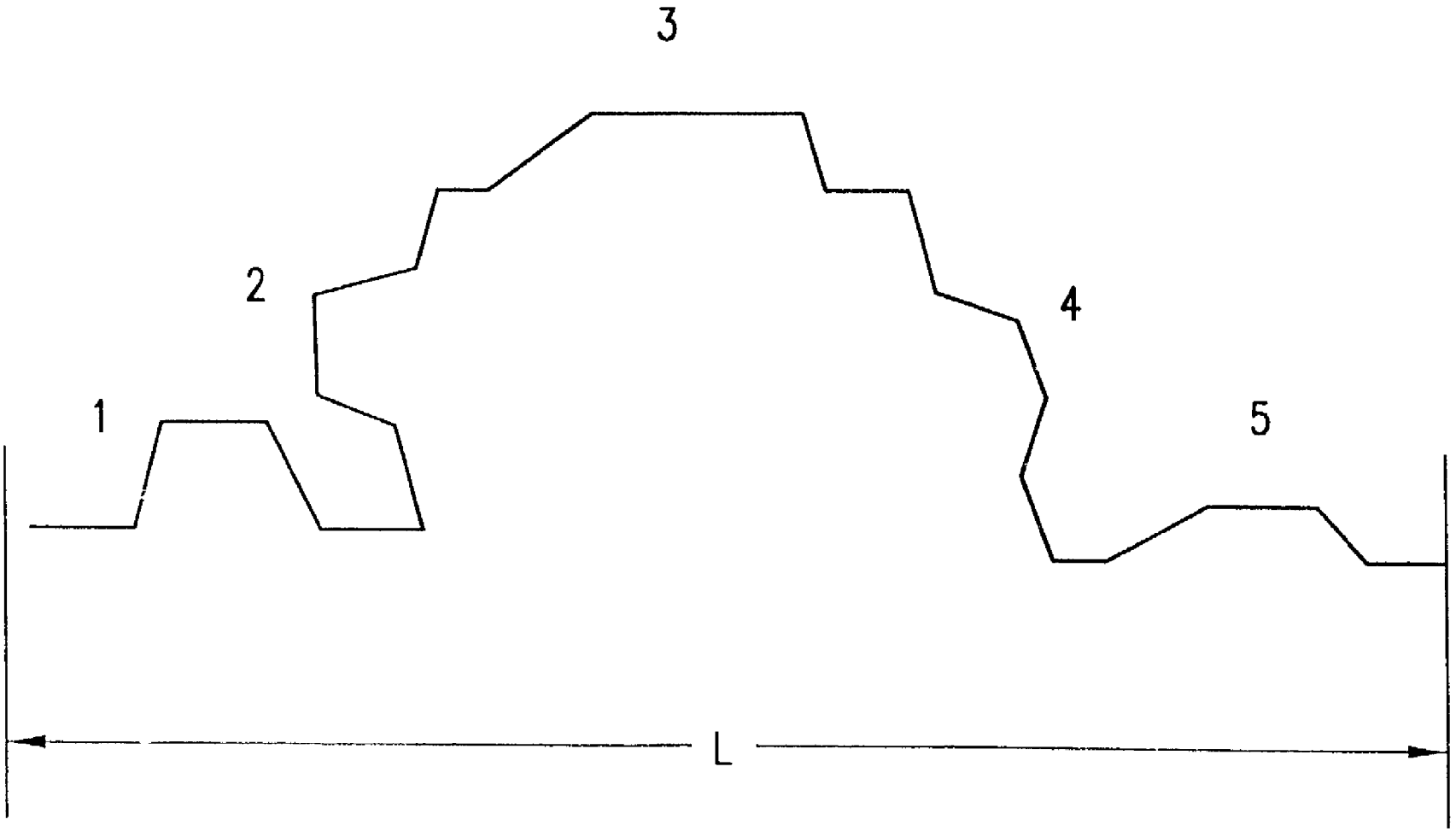
FIG. 41 illustrates an exemplary geometry resulting from GA optimization of a semi-fractal pattern.

FIG. 40 provides an illustration of how this method may differ from an approach that is restricted to a subset of fractal geometries. In FIG. 40, a simple pattern is not simply rotated, stretched, or scaled as in a typical IFS. Rather, for each element of the simple pattern, a new pattern is produced. The new pattern is not merely a reproduction of the original pattern. Rather, the angles and segment lengths of the pattern are varied in each new simple pattern. These patterns are then connected in a manner corresponding to the connection of segments of the simple pattern. For example, in FIG. 40, the antenna pattern is built of five variations of a simple pattern. Each of these variations is similar, but none have the same relative angles or proportions between segments. Each of these patterns may be optimized independently by applying the genetic algorithm. Hence, as illustrated in FIG. 41, the resulting pattern is not a fractal structure since it cannot be generated by a simple translation, rotation and scaling of a single generating pattern.

According to another embodiment, a "stochastic antenna" design methodology may be used which employs a GA to evolve a general class of antenna shapes that offer optimal performance characteristics. This method utilizes the GA to optimize arbitrarily-shaped antennas with or without reactive loads.

Figure 42:
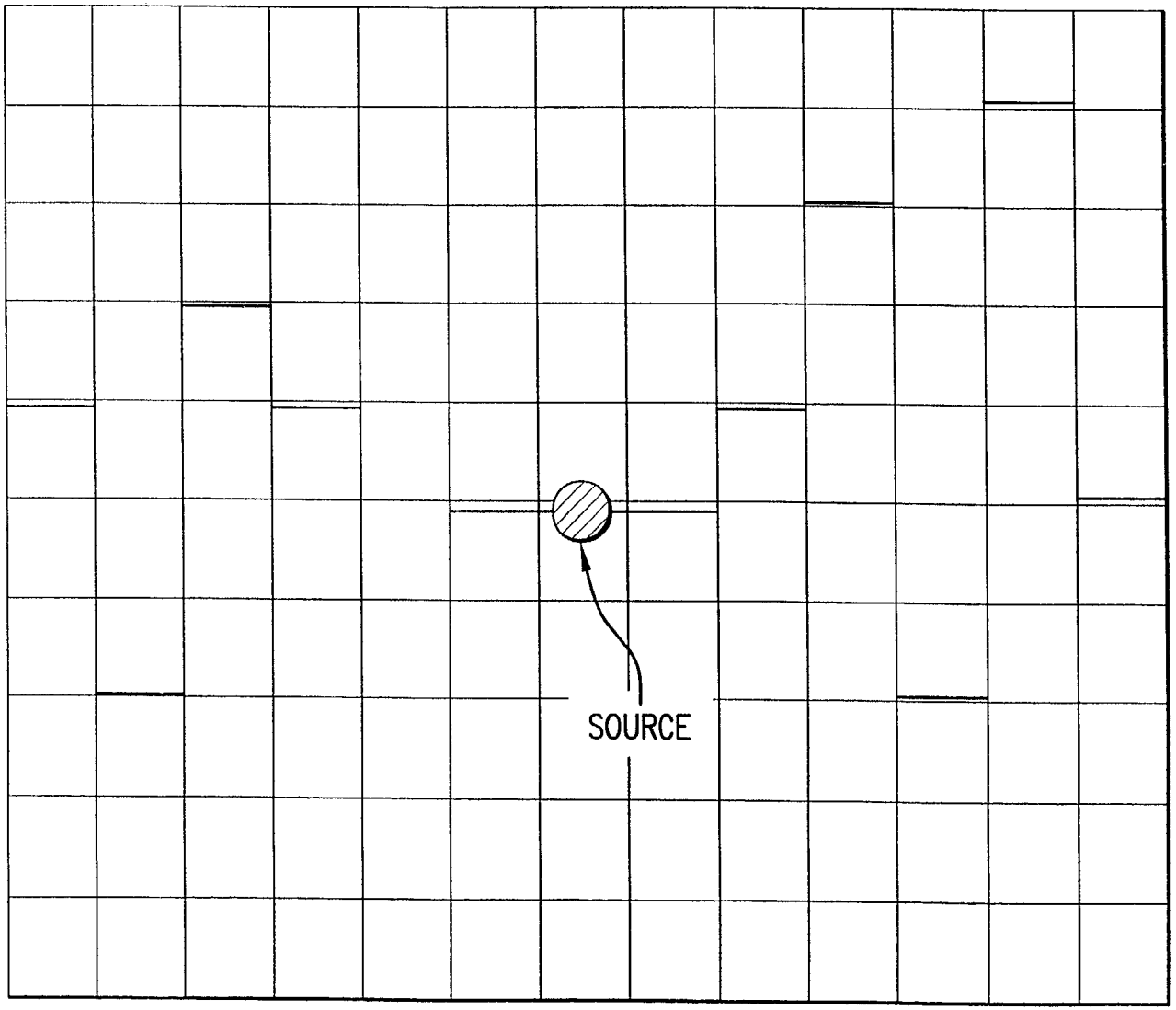
FIG. 42 illustrates a random selection of elements of an antenna according to an exemplary embodiment.
Figure 43:
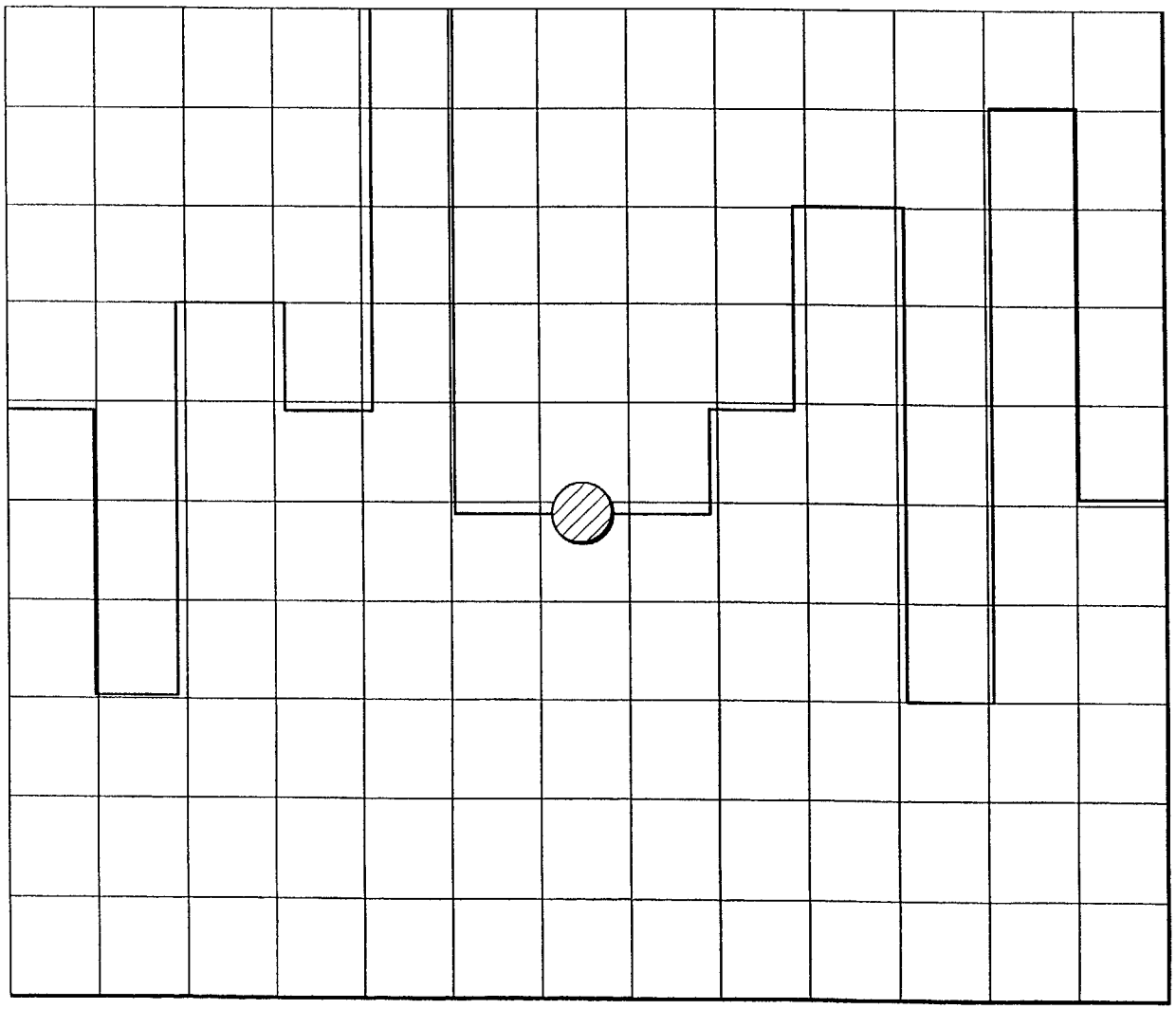
FIG. 43 illustrates application of a stochastic process to a randomly selected configuration of elements according to an exemplary embodiment.

In the first step of the process according to this embodiment, elements oriented in a particular direction, e.g., horizontal elements that are located in a fixed grid geometry as illustrated in FIG. 42, are selected. These elements may be considered a simple pattern. Elements that connect to the horizontal elements, e.g., vertical elements, are then selected to form an antenna structure such as that shown in FIG. 43. This selection of elements oriented in one direction and selection of elements connecting to those elements may be referred to as a "stochastic" process. This "stochastic" process may be performed as a subroutine in the system shown in FIG. 9.

Figure 44:
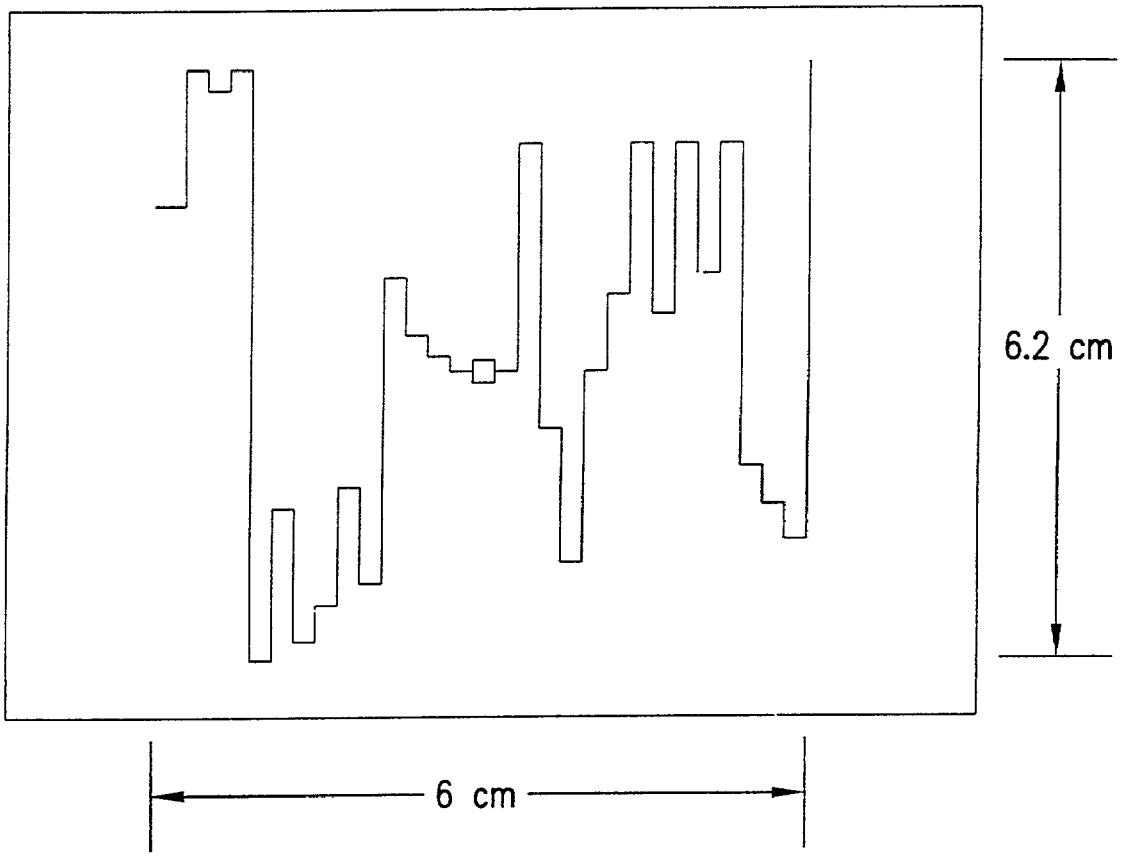
FIG. 44 illustrates exemplary results of a GA optimization process applied to a randomly selected simple pattern.

Through the optimization process, the GA evolves the stochastic antenna structure towards the final configuration that best meets the desired design objectives as shown, for example, in FIG. 44. FIG. 44 shows an example of a dual band stochastic antenna synthesized via the GA optimization technique according to this embodiment.

This stochastic design optimization procedure is applicable to two-dimensional and three-dimensional wire antenna structures, as well as microstrip antennas mounted on a substrate material. The optimized antenna structures may also include one or more reactive loads consisting of a network of capacitors and inductors. Resistive elements may also be used in some cases. Nonlinear devices such as varicaps or varactors may be used in the loads to provide multiband tunability. Active loads may also be used (including negative impedance, fractional impedance, and higher-order impedance loads) such that the impedance of the individual load components may be expressed in the form:

$$Z_L = \pm(j\omega)^{\nu} \text{ where } \nu \text{ is any positive or negative real number including zero}$$

These loads may be elements in a simple network or a complex network.

The stochastic antenna system may include a balun and a matching network. In this case, the balun configuration as well as the matching network topology and associated component values may be optimized simultaneously with the antenna geometry and loads.

Figure 45:
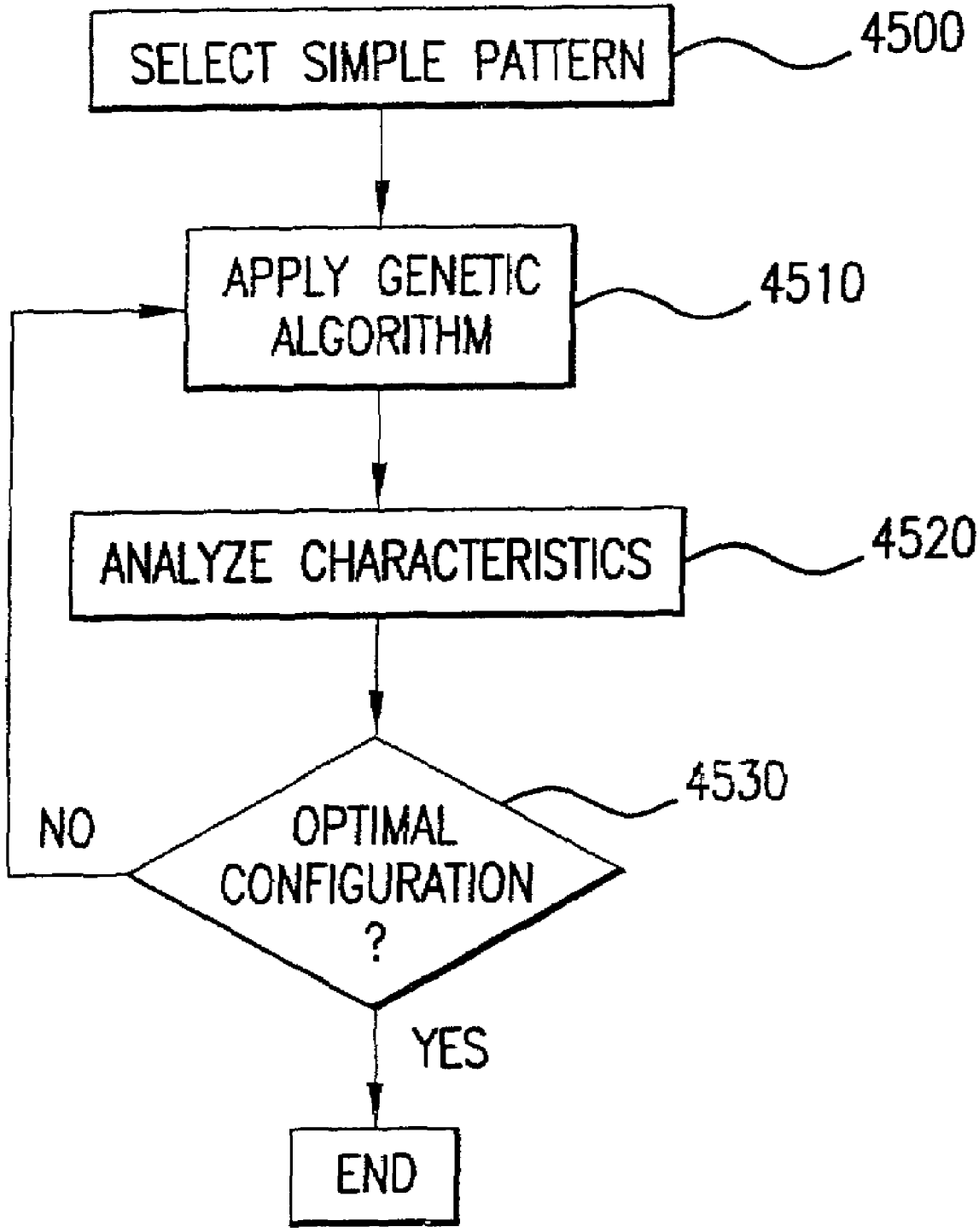
FIG. 45 illustrates an exemplary method for generating a configuration of elements according to exemplary embodiments.

FIG. 45 illustrates an exemplary method for generating a configuration of elements, e.g., antenna elements within an antenna or antennas within an array of antennas, according to an exemplary embodiment. The method begins at step 4500 at which a simple configuration is generated. This configuration may be a randomly selected pattern or a motif. Although not shown, an iterated or semi-iterated process may be performed next on the simple pattern, to produce a fractal or a semi-fractal pattern, respectively. Alternatively, elements oriented in one direction may be selected, and elements connecting these elements in at least one second direction may be selected in a stochastic process.

At step 4510, a genetic algorithm is applied to the simple configuration. Of course, it will be appreciated that the iterated, semi-iterated, and stochastic processes need not be performed before application of the genetic algorithm. Rather, the iterated, semi-iterated, or stochastic processes may be performed after the genetic algorithm is applied to a simple pattern, and the application of the genetic algorithm may be repeated as necessary.

At step 4520, the radiation characteristics of the configuration are determined. At step 4530, a determination is made whether the pattern is optimal, i.e., whether or not the pattern has converged to a pattern that produces optimal characteristics. If not, the analysis results are used in the application of the genetic algorithm at step 4510. The steps of applying a genetic algorithm and analyzing characteristics repeat until the determination is made at step 4530 that the results are optimal, e.g., that the pattern has converged to an optimal point.

Although the descriptions above relate mainly to optimization of elements in individual antennas, it will be appreciated that the invention is not so limited. The genetic algorithm may also be applied to generate an optimal configuration for antennas within an array. The genetic algorithm may also be applied to optimize antennas and antenna arrays containing radiating elements (active elements) and reflectors and directors (passive elements).

Also, in addition to antenna applications, the GA may be applied to generate optimized patterns for other types of devices, e.g., frequency selective surfaces (FSS). According to an exemplary embodiment, the GA may be applied to a pattern of electromagnetic materials, such as metallic conductors, arranged on any conventional substrate or superstrate, such as a circuit board, Teflon, alumina, etc. It will be appreciated that the invention is not limited to patterns of metallic conductors but may also be applicable to other types of conductors, or magnetic/dielectric materials. The GA may also be applied to optimize characteristics of the substrate or superstrate, such as the dielectric constant and/or the thickness.

The process shown in FIG. 45 may be used for generating a pattern for a frequency selective surface, except that the configuration produced is an FSS configuration of electromagnetic materials, rather than an antenna configuration of elements. Also, the genetic algorithm may optimize for characteristics suitable for the FSS, e.g., the thickness and dielectric constant of the substrate or superstrate on which the electromagnetic materials are placed.

Figure 46:
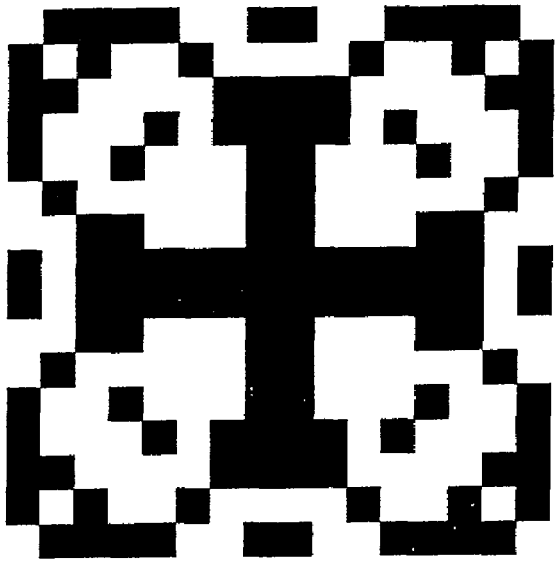
FIGS. 46 and 47 illustrate examples of a multiband, high impedance frequency selective surface pattern synthesized using a GA algorithm.
Figure 47:
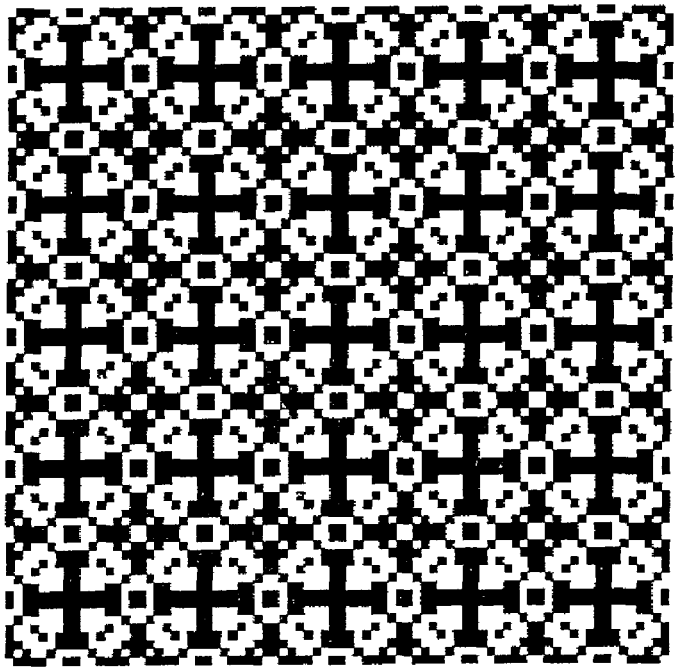

FIGS. 46 and 47 illustrate examples of a multiband, high impedance FSS, the electromagnetic pattern and characteristics of which are synthesized via a GA. In FIG. 47, a single cell of the FSS is shown, and in FIG. 48, a corresponding FSS screen formed of a combination of cells is shown. It will be appreciated that a genetically engineered FSS may also be single band. By incorporating a GA into the development process, it is possible to modify the geometry of the FSS cell/screen as well as the dielectric constant and thickness of any substrate or superstrate material.

Although only one screen is shown in FIG. 48, it will be appreciated that any number of screens, as well as dielectric layers, may be produced. These screens and layers may be stacked. Such stacks may include a conducting plate, e.g., a metallic plate, as a ground plane.

According to this embodiment, the GA may be implemented as software on a personal computer, such as the computer 1000 shown in FIG. 10. The personal computer may receive inputs from a user specifying an initial pattern and initial characteristics of the substrate/superstrate. The inputs may be provided via a user interface, e.g., a keyboard. The results of the optimization may be displayed on, e.g., a computer terminal. The user may use the results to construct an FSS.

According to this embodiment, the GA optimizes the pattern of the electromagnetic material and characteristics of the substrate/superstrate to enhance performance characteristics of the frequency selective surface formed by arranging the electromagnetic materials on the substrate/superstrate. According to one embodiment, the GA optimizes for a reflection coefficient of a high impedance ground plane that has zero phase and is as close to unity amplitude as possible.

The FSS formed using the optimized pattern and characteristics may be used, e.g., as a ground plane in a high impedance, single band or multiband antenna system, improving the radiation characteristics of the antenna. Of course, there may be uses for an FSS other than a ground plane in an antenna system, and the invention is not limited to this embodiment.

For example, by using the GA to generate the FSS, a low-profile antenna system may be produced. Thus, using a genetically engineered FSS enables antenna arrays to have fewer antenna elements. Also, using the genetically engineered FSS enables antennas which could not have previously been placed near metal objects to now be placed on them. In addition, using a genetically engineered FSS improves the efficiency as well as the gain and beam pattern of antennas and antenna arrays. Genetically engineered FSSs may also include adjustable components, e.g., electrically adjustable materials, varactor diodes, etc., that may be used to tune the frequency response to enhance beam shaping and steering. A genetically engineered FSS may also be used to shield sensitive areas from exposure to radio frequency energy while in the presence of an antenna, e.g., to shield a user's head from radio frequency energy while using a cellular telephone.

Finally, it will be appreciated that the invention may be applied to any combination of antennas, antenna arrays, and/or frequency selective surface(s) which may be planar or non-planar.

While the invention has been described with reference to specific embodiments, modifications and variations of the invention may be constructed without departing from the scope of the invention.

It should be understood that the foregoing description and accompanying drawings are by example only. A variety of modifications are envisioned that do not depart from the scope and spirit of the invention.

The above description is intended by way of example only and is not intended to limit the present invention in any way.

What is claimed is:

1. A method for generating a configuration of elements for at least one antenna, comprising the steps of:

selecting a simple antenna configuration including at least one antenna element;

applying a genetic algorithm to the simple configuration to generate an antenna configuration optimized for antenna characteristics; and creating a pattern for a frequency selective surface for improving radiation characteristics of the antenna.

2. The method of claim 1, further comprising a step of analyzing radiation characteristics of the simple antenna configuration, wherein the radiation characteristics are used in the step of applying a genetic algorithm to generate the antenna configuration optimized for antenna characteristics.

3. The method of claim 2, wherein the step of applying the genetic algorithm includes generating candidate antenna configurations, the step of analyzing radiation characteristics includes analyzing radiation characteristics of the candidate antenna configurations, and the steps of applying the genetic algorithm and analyzing radiation characteristics are repeated until the step of applying a genetic algorithm generates an optimal antenna configuration.

4. The method of claim 1, wherein the antenna characteristics include at least one of voltage standing wave ratio, gain, size, bandwidth, radiation pattern, and impedance.

5. The method of claim 1, wherein the step of applying the genetic algorithm optimizes at least one of geometry of elements, height of the antenna above a ground plane, and length of the antenna.

6. The method of claim 1, wherein the step of applying the genetic algorith generates at least one of optimized load placement and optimized load values for the antenna configuration.

7. The method of claim 1, wherein the step of applying the genetic algorithm generates optimized design parameters of a matching network or balun to be connected to the antenna.

8. The method of claim 1, wherein the step of selecting the simple antenna configuration comprises randomly selecting antenna elements.

9. The method of claim 8, further comprising selecting elements that connect to the randomly selected elements to produce a stochastic configuration to which the genetic algorithm is applied.

10. The method of claim 1, wherein the step of applying the genetic algorithm includes optimizing each element of the antenna independently.

11. The method of claim 1, wherein the step of selecting the simple antenna configuration comprises selecting a motif.

12. The method of claim 1, wherein the simple antenna configuration is a Werner pattern.

13. The method of claim 1, further comprising performing an iterated process on the simple configuration to produce a fractal pattern to which the genetic algorithm is applied.

14. The method of claim 1, further comprising performing a semi-iterated process on the simple configuration to produce a semi-fractal pattern to which the genetic algorithm is applied.

15. The method of claim 1, wherein the step of applying the genetic algorithm generates a configuration of an array of antennas.

16. The method of claim 1, wherein the step of applying the genetic algorithm generates a configuration of elements for an individual antenna.

17. The method of claim 1, the steps of applying the genetic algorithm generates a configuration of antennas within an array and configurations of elements of the individual antennas within the array.

18. The method of claim 1, wherein the step of creating the pattern for the frequency selective surface comprises:

selecting a pattern for arranging electromagnetic materials on a substrate or a superstrate; and applying the genetic algorithm to the selected pattern to generate an optimized pattern of electromagnetic materials for forming a frequency selective surface on the substrate or superstrate.

19. A system for generating a configuration of elements for at least one antenna, comprising:

means for selecting a simple antenna configuration including at least one antenna element;

means for applying a genetic algorithm to the simple configuration to generate an antenna configuration optimized for antenna characteristics; and means for creating a pattern for a frequency selective surface for improving radiation characteristics of the antenna.

20. The system of claim 19, further comprising:

means for analyzing radiation characteristics of the simple antenna configuration, wherein the radiation characteristics are used by the means for applying the genetic algorithm to generate the antenna configuration optimized for antenna characteristics.

21. The system of claim 20, wherein the means for applying the genetic algorithm generates candidate antenna configurations, and the means for analyzing radiation characteristics analyzes radiation characteristics of the candidate antenna configurations until the means for applying a genetic algorithm generates an optimal antenna configuration.

22. The system of claim 19, wherein the antenna characteristics include at least one of a ,voltage standing wave ratio, gain, size, bandwidth, radiation pattern, and impedance.

23. The system of claim 19, wherein the means for applying the genetic algorithm optimizes at least one of geometry of elements, height of the antenna above the ground plane, and length of the antenna.

24. The system of claim 19, wherein the means for applying the genetic algorithm generates at least one of optimized load placement and optimized load values for the antenna configuration.

25. The system of claim 19, wherein the means for applying the genetic algorithm generates optimized design parameters for a matching network or balun to be connected to the antenna.

26. The system of claim 19, wherein the means for selecting the simple antenna configuration randomly selects antenna elements.

27. The system of claim 26, further comprising means for selecting elements that connect to the randomly selected elements to produce a stochastic configuration to which the genetic algorithm is applied.

28. The system of claim 19, wherein the means for applying the genetic algorithm optimizes each element of the antenna configuration independently.

29. The system of claim 19, wherein the simple configuration selected is a motif.

30. The system of claim 19, wherein the simple configuration selected is a Werner pattern.

31. The system of claim 19, further comprising means for performing an iterated process on the simple configuration to produce a fractal pattern to which the genetic algorithm is applied.

32. The system of claim 19, further comprising means for performing a semi-iterated process on the simple configuration to produce a semi-fractal pattern to which the genetic algorithm is applied.

33. The system of claim 19, wherein the configuration of elements generated is a configuration of an array of antennas.

34. The system of claim 19, wherein configurations of elements for individual antennas are generated.

35. The system of claim 19, wherein configurations of elements for individual antennas are generated, and a configuration of the antennas within an array are generated.

36. The system of claim 19, wherein the means for creating a pattern for a frequency selective surface comprises:

means for selecting a pattern for arranging electromagnetic materials on a substrate or a superstrate; and means for applying a genetic algorithm to the selected pattern to generate an optimized pattern of electromagnetic materials for forming a frequency selective surface on the substrate or superstrate.

37. A method for creating a pattern of electromagnetic materials on a substrate or superstrate for forming at least one frequency selective surface, comprising:

selecting a pattern for arranging the electromagnetic materials on the substrate or the superstrate;

applying a genetic algorithm to the selected pattern to generate an optimized pattern of electromagnetic materials for forming a frequency selective surface on the substrate or superstrate.

38. The method of claim 37, wherein the step of applying the genetic algorithm comprises modifying a geometry of the pattern.

39. The method of claim 38, wherein the step of applying the genetic algorithm also applies a genetic algorithm to characteristics of the substrate or superstrate to optimize these characteristics.

40. The method of claim 39, wherein the characteristics of the substrate or superstrate that are optimized include at least one of a thickness and a dielectric constant of the substrate or superstrate.

41. The method of claim 37, wherein the frequency selective surface includes a combination of frequency selective cells forming a screen.

42. The method of claim 41, wherein patterns for multiple screens and dielectric layers are produced by the method.

43. The method of claim 42, wherein the genetic algorithm is applied to generate an optimized stack of multiple screens and dielectric layers.

44. The method of claim 37, wherein the frequency selective surface is a high impedance, single band or multiband surface.

45. The method of claim 37, wherein the frequency selective surface forms a high impedance ground plane for a single band or multiband antenna.

46. The method of claim 37, wherein the frequency selective surface is part of a shield for shielding radio frequency energy emitted by an antenna.

47. The method of claim 37, wherein the frequency selective surface contains adjustable components enabling a frequency response of the frequency selective surface to be adjusted.

48. A system for creating a pattern of electromagnetic materials on a substrate or superstrate for forming at least one frequency selective surface, comprising:

means for selecting a pattern for arranging the electromagnetic materials on the substrate or superstrate; and means for applying a genetic algorithm to the selected pattern to generate an optimized pattern of electromagnetic materials for forming a frequency selective surface on the substrate or superstrate.

49. The system of claim 48, wherein the means for applying the genetic algorithm comprises means for modifying a geometry of the pattern.

50. The system of claim 49, wherein the means for applying the genetic algorithm also applies a genetic algorithm to characteristics of the substrate or superstrate to optimize these characteristics.

51. The system of claim 50, wherein the characteristics of the substrate or superstrate that are optimized include at least one of a thickness and a dielectric constant of the substrate or superstrate.

52. The system of claim 48, wherein the frequency selective surface includes a combination of frequency selective cells.

53. The system of claim 52, wherein patterns for multiple screens and dielectric layers are produced by the apparatus.

54. The system of claim 53, wherein the genetic algorithm is applied to generate an optimized stack of multiple screens and dielectric layers.

55. The system of claim 48, wherein the frequency selective surface is a high impedance, single band or multiband surface.

56. The system of claim 48, wherein the frequency selective surface forms a high impedance ground plane for a single band or multiband antenna.

57. The system of claim 48, wherein the frequency selective surface is part of a shield for shielding radio frequency energy emitted by an antenna.

58. The system of claim 48, wherein the frequency selective surface contains adjustable components enabling a frequency response of the frequency selective surface to be adjusted.

59. A method for generating a configuration of elements for at least one antenna, comprising the steps of:

selecting a simple antenna configuration including at least one antenna element;

applying a genetic algorithm to the simple configuration to generate an antenna configuration optimized for antenna characteristics; and applying a genetic algorithm to generate optimized design parameters of a matching network or balun to be connected to the antenna.

60. A method for generating a configuration of elements for at least one antenna, comprising the steps of:

selecting a simple antenna configuration including at least one antenna element, wherein the step of selecting a simple antenna configuration comprises selecting a motif; and applying a genetic algorithm to the simple configuration to generate an antenna configuration optimized for antenna characteristics.

61. A method for generating a configuration of elements for at least one antenna, comprising the steps of:

selecting a simple antenna configuration including at least one antenna element, wherein the simple antenna configuration is a Werner pattern; and applying a genetic algorithm to the simple configuration to generate an antenna configuration optimized for antenna characteristics.

62. A method for generating a configuration of elements for at least one antenna, comprising the steps of:

selecting a simple antenna configuration including at least one antenna element;

applying a genetic algorithm to the simple configuration to generate an antenna configuration optimized for antenna characteristics; and performing an iterated process on the simple configuration to produce a fractal pattern to which the genetic algorithm is applied.

63. A method for generating a configuration of elements for at least one antenna, comprising the steps of:

selecting a simple antenna configuration including at least one antenna element;

applying a genetic algorithm to the simple configuration to generate an antenna configuration optimized for antenna characteristics; and performing a semi-iterated process on the simple configuration to produce a semi-fractal pattern to which the genetic algorithm is applied.

64. A method for generating a configuration of elements for at least one antenna, comprising the steps of:

selecting a simple antenna configuration including at least one antenna element;

applying a genetic algorithm to the simple configuration to generate an antenna configuration optimized for antenna characteristics, wherein the step of applying a genetic algorithm generates a configuration of an array of antennas.

65. A method for generating a configuration of elements for at least one antenna, comprising the steps of:

selecting a simple antenna configuration including at least one antenna element;

applying a genetic algorithm to the simple configuration to generate an antenna configuration optimized for antenna characteristics, wherein the step of applying a genetic algorithm generates a configuration of antennas within an array and configurations of elements of the individual antennas within the array.

66. A system for generating a configuration of elements for at least one antenna, comprising:

means for selecting a simple antenna configuration including at least one antenna element, wherein the simple configuration selected is a Werner pattern; and means for applying a genetic algorithm to the simple configuration to generate an antenna configuration optimized for antenna characteristics.

67. A system for generating a configuration of elements for at least one antenna, comprising:

means for selecting a simple antenna configuration including at least one antenna element;

means for applying a genetic algorithm to the simple configuration to generate an antenna configuration optimized for antenna characteristics; and means for performing an iterated process on the simple configuration to produce a fractal pattern to which the genetic algorithm is applied.

68. A system for generating a configuration of elements for at least one antenna, comprising:

means for selecting a simple antenna configuration including at least one antenna element;

means for applying a genetic algorithm to the simple configuration to generate an antenna configuration optimized for antenna characteristics; and means for performing a semi-iterated process on the simple configuration to produce a semi-fractal pattern to which the genetic algorithm is applied.

69. A system for generating a configuration of elements for at least one antenna, comprising:

means for selecting a simple antenna configuration including at least one antenna element; and means for applying a genetic algorithm to the simple configuration to generate an antenna configuration optimized for antenna characteristics, wherein the configuration of elements generated is a configuration of an array of antennas.

70. A system for generating a configuration of elements for at least one antenna, comprising:

means for selecting a simple antenna configuration including at least one antenna element; and means for applying a genetic algorithm to the simple configuration to generate an antenna configuration optimized for antenna characteristics, wherein configurations of elements for individual antennas are generated.

71. A system for generating a configuration of elements for at least one antenna, comprising:

means for selecting a simple antenna configuration including at least one antenna element; and means for applying a genetic algorithm to the simple configuration to generate an antenna configuration optimized for antenna characteristics, wherein configurations of elements for individual antennas are generated, and a configuration of the antennas within an array are generated.

* * * * *